US010893581B2

(12) United States Patent
Ibragimov

(10) Patent No.: US 10,893,581 B2
(45) Date of Patent: Jan. 12, 2021

(54) HEATING OF OBJECTS BY MICROWAVE ENERGY

(71) Applicant: GOJI LIMITED, Hamilton (BM)

(72) Inventor: Zalman Ibragimov, Rehovot (IL)

(73) Assignee: GOJI LIMITED, Hamilton (BM)

( * ) Notice: Subject to any disclaimer, the term of this patent is extended or adjusted under 35 U.S.C. 154(b) by 711 days.

(21) Appl. No.: 15/322,329

(22) PCT Filed: Jun. 30, 2015

(86) PCT No.: PCT/EP2015/064906
§ 371 (c)(1),
(2) Date: Dec. 27, 2016

(87) PCT Pub. No.: WO2016/001260
PCT Pub. Date: Jan. 7, 2016

(65) Prior Publication Data

US 2018/0220497 A1 Aug. 2, 2018

Related U.S. Application Data

(60) Provisional application No. 62/107,715, filed on Jan. 26, 2015, provisional application No. 62/018,688, filed on Jun. 30, 2014.

(51) Int. Cl.
*H05B 6/64* (2006.01)
*H05B 6/68* (2006.01)
*H05B 6/72* (2006.01)

(52) U.S. Cl.
CPC ..... *H05B 6/6473* (2013.01); *H05B 6/6488* (2013.01); *H05B 6/6494* (2013.01); *H05B 6/682* (2013.01); *H05B 6/72* (2013.01)

(58) Field of Classification Search
CPC .. H05B 6/6473; H05B 6/6488; H05B 6/6494; H05B 6/682; H05B 6/72; H05B 6/6447;
(Continued)

(56) References Cited

U.S. PATENT DOCUMENTS 3,680,136 A 7/1972 Collings
3,934,106 A * 1/1976 MacMaster ..... H05B 6/6411 219/728

(Continued)

FOREIGN PATENT DOCUMENTS

DE 42 40 104 6/1994
GB 1407852 9/1975

(Continued)

OTHER PUBLICATIONS

International Search Report issued in PCT/EP2015/064906, dated Sep. 24, 2015.

*Primary Examiner* — Tu B Hoang
*Assistant Examiner* — Tiffany T Tran
(74) *Attorney, Agent, or Firm* — Greenblum & Bernstein, P.L.C.

(57) ABSTRACT

An apparatus for heating a load with microwave energy is provided. The microwave energy is applied by the apparatus at frequencies wherein the load's dielectric constant is within a predetermined range. The apparatus may include a microwave power source configured to supply microwave energy at the applied frequencies; and a radiating plate. The radiating plate may include an electrically conductive structure that includes a plurality of radiating elements; and a feeding port, connecting the electrically conductive structure to the microwave power source. The radiating plate is configured so that most of the power fed from the microwave source through the feeding port returns towards the power source when no load is contacting the radiating plate, and most of the power fed from the microwave source through the feeding port is absorbed by the load to be heated by the apparatus when the load is contacting the radiating plate, even in absence of a microwave cavity that encloses the radiating plate and the load.

27 Claims, 12 Drawing Sheets

(58) Field of Classification Search

CPC ..... H05B 6/68; H05B 6/687; H05B 6/705; H05B 6/664; H05B 6/688; H05B 6/70; H05B 1/02; H05B 2206/044; H05B 6/00; H05B 6/6455; H05B 6/686; B65D 2581/347; B65D 2581/3479; B65D 2581/3487; B65D 2581/349; B65D 2581/3493; B65D 2581/3495; B65D 25/00; B65D 25/02; B65D 25/36; B65D 43/0204; B65D 43/06; B65D 51/20; B65D 59/04; B65D 5/545; B65D 77/2012; B65D 77/2032; B65D 81/34; H01L 21/67115

USPC ..... 219/706, 750, 482, 660, 661, 746, 728, 219/730, 732, 745, 729, 763, 725, 734, 219/759, 700, 748, 702, 716, 761; 99/450, 410, 336, 403, 413, 415, 417

See application file for complete search history.

(56) References Cited

U.S. PATENT DOCUMENTS

| | | | | |
|---|---|---|---|---|
| 4,695,693 | A * | 9/1987 | Staats | H05B 6/72 219/738 |
| 4,992,638 | A * | 2/1991 | Hewitt | B65D 81/3453 219/728 |
| 5,057,659 | A | 10/1991 | Schneider et al. | |
| 5,322,984 | A * | 6/1994 | Habeger, Jr. | B65D 81/3446 219/728 |
| 5,347,108 | A * | 9/1994 | Minakawa | H05B 6/6464 219/696 |
| 5,466,917 | A | 11/1995 | Matsuki et al. | |
| 6,231,903 | B1 | 5/2001 | Ji et al. | |
| 6,259,079 | B1 | 7/2001 | Ji et al. | |
| 6,501,059 | B1 | 12/2002 | Mast | |
| 2003/0043077 | A1* | 3/2003 | Alexopoulos | H01Q 9/27 343/700 MS |
| 2007/0068937 | A1 | 3/2007 | Risman | |
| 2009/0032528 | A1 | 2/2009 | Risman | |
| 2011/0168699 | A1* | 7/2011 | Oomori | H01L 21/67115 219/748 |
| 2012/0312801 | A1* | 12/2012 | Bilchinsky | H05B 1/02 219/438 |
| 2013/0080098 | A1* | 3/2013 | Hadad | G01N 27/00 702/66 |
| 2013/0284725 | A1* | 10/2013 | Bilchinsky | H05B 6/688 219/709 |
| 2015/0009075 | A1* | 1/2015 | Lau | H01Q 21/28 343/702 |
| 2016/0095171 | A1* | 3/2016 | Chaimov | H05B 6/664 219/704 |

FOREIGN PATENT DOCUMENTS

| | | |
|---|---|---|
| GB | 2037546 | 7/1980 |
| GB | 2 186 478 | 8/1987 |
| WO | 92/22179 | 12/1992 |
| WO | 00/24228 | 4/2000 |
| WO | 01/23275 | 4/2001 |
| WO | 02/34013 | 4/2002 |

* cited by examiner

HEATING OF OBJECTS BY MICROWAVE ENERGY

FIELD AND BACKGROUND

The present disclosure is in the field of heating objects by microwave energy, and more particularly, but not exclusively, to such heating utilizing evanescent waves.

Some technical background may be found, for example, in U.S. Pat. Nos. 3,680,136; 4,695,693; PCT patent application publication No. WO 00/24228; British patent application publication No. GB 2,037,546, and German patent application publication No. DE4240104.

SUMMARY

In some embodiments, there is provided a radiating plate configured to be fed with feed signals having a range of microwave working frequencies, the radiating plate comprising a ground plate and one or more radiating elements spaced therefrom by a dielectric layer. The radiating plate has a free space efficiency less than −6 dB and a contact efficiency greater than 0.5. The free space efficiency is a ratio of power not returned from the radiating plate to power fed to the radiating plate at a test frequency in the range of working frequencies in a free space condition when a volume of free space covers the radiating plate. The contact efficiency is a ratio of power not returned from the radiating plate when a test load rests on top of the radiating plate to power fed to the radiating plate at the test frequency. The test load has a dielectric constant in the range of 20 to 60 and a loss tangent in the range of 0.1 to 0.5 at the test frequency. However, the invention is not limited to a test load of any particular characteristics.

It will be understood that the above condition on free space efficiency may not be met for all free space volumes, e.g. it may not be met for very small ones where the radiating plate "sees" not only free space. All that is required is that a free space volume exists in which the above condition is met. A suitable bound for a free space volume may be a volume chosen so that when the volume is increased by a set amount, e.g. doubled or by 10, 25 or 50%, no measurable change occurs in free space efficiency. If such a steady state free space efficiency is below the threshold above, the above condition is met. A suitable free space volume may be a volume covering the radiating plate and having a height of 10 cm, 5 cm or therebetween above the radiating plate.

Likewise, it will be understood that the above condition on contact efficiency may not be met for all test loads falling within the ranges of dielectric constant and loss tangent. All that is required is that a test load exists that meets the above condition. A suitable bound for a test load may be a test load having dielectric properties within the above ranges and a volume such that when the volume is increased, say doubled or increased by 10, 15 or 50%, no measurable change occurs in the contact efficiency. If such steady state contact efficiency is above the threshold above, the above condition is met. A suitable test load may be a test load having dielectric properties within the above ranges, covering the radiating plate and having a height of 5 cm, 10 cm or therebetween above the radiating plate. For example, the test load may have homogenous dielectric properties, or may have a variety of different dielectric properties spatially distributed, for example as in a plate of different food stuffs.

By configuring the radiating plate such that it is a "bad" antenna in free space, that is it does not radiate into free space or at least only very little, while arranging the radiating plate such that it readily transfers energy into a load like the test load, various benefits can be achieved. In particular, the radiating plate, because it is tuned to load and not to a cavity as in conventional antennas for microwaves, can be used with many different enclosures, including with many different microwave cavities without having to redesign for each enclosure. Moreover, if desired, the enclosure can even be dispensed with. It will be understood that the radiating plate is suitable for use with a range of loads of which the test load is characteristic. While the actual contact efficiency of the radiating plate will depend on the details of any load being heated with a radiating plate, it will be appreciated that significant energy transfer can be achieved for a range of loads similar to the test load. The simple definition of the test load and of the threshold for the contact efficiency, used above is employed for the convenience of clear definition, rather than to limit the loads with which the radiating plate may be used.

It will be understood that any one design of radiating plate will be specific to the range of working frequencies chosen and will be optimised to provide significant energy transfer when in contact with the load while not radiating energy when not in contact with the load, as measured by the above condition, for example. However, for any radiating plate design and corresponding range of working frequencies, a test load as defined above can be used to determine a contact efficiency of the radiating plate in question.

In some embodiments, the free space efficiency is less than −8, −10, −15, −20, −25, or −30 dB. In some embodiments, the contact efficiency is greater than 0.6, 0.7, 0.8, or 0.9. It will be understood that any two combinations of the two thresholds from the above lists are equally disclosed.

The free space efficiency of the radiating plate may be less than −6 dB and the contact efficiency of the radiating plate may be greater than 0.5 for test loads having a dielectric constant in the range of 20 to 60 and/or a loss tangent in the range of 0.1 to 0.5. It will be appreciated that this is a stricter requirement as the one set out above, as the conditions and questions are to be met for any loads having a configuration as the test load described above but a dielectric constant and/or loss tangent within the respective range.

In some embodiments, the dielectric layer (also sometimes referred to as "insulating layer" herein) is a solid material, optionally, the dielectric layer has loss tangent less than 0.005. In some embodiments, the loss tangent may be less than 0.001. In some embodiments, the dielectric layer may comprise or consist of a layer of air. It will be understood that the dielectric layer would act as an insulator to electrically separate the radiating element from the ground plate.

In some embodiments, a dielectric cover layer may cover the radiating elements on a side of the radiating elements not facing the dielectric layer. The dielectric cover layer may be made from food grade material. In some embodiments, the dielectric cover layer is made of the same material as the dielectric layer, and in some embodiments, not.

In some embodiments, the radiating plate is arranged to be able to act as a load-bearing plate capable of supporting a load with weight 1 kg. The radiating plate may be arranged so as to be able to act as load-bearing plate for heavier loads, for example 2 kg, 5 kg or even 10 kg. The radiating plate may be arranged to act as a load-bearing plate in the way described above when supported only near its edges, or incorporating additional supports over the area of the radiating plate to achieve the desired load-bearing characteristic. In some embodiments, the above load-bearing characteristic is defined in terms of a crush limit, wherein the radiating plate requires support over its entire area to withstand the forces corresponding to the loads described above.

In some embodiments, the radiating plate comprises a plurality of decoupled radiating elements, decoupled from each other at the working frequencies. Each radiating element may be fed by a respective feed. The decoupled radiating elements may be electrically isolated from each other, or maybe decoupled by a respective current barrier or field obstructing element, for example, a choke.

In some embodiments, the radiating elements are printed on a support. The support may be the dielectric layer between the radiating elements and the ground plate. Alternatively, the radiating elements may be printed on a separate support such as a PCB plate or suitable foil.

In some embodiments, an apparatus for heating an object comprises a radiating plate as described above. The apparatus further comprises an enclosure for accepting an object adjacent the radiating plate for heating. In some embodiments, the apparatus may comprise the radiating plate and a microwave power source coupled to the radiating plate and configured to feed the radiating plate at one or more frequencies within the range of working frequencies. The radiating plate may be disposed in a tray configuration enabling the object to rest on top of the radiating plate when the object is disposed adjacent the radiating plate. In some embodiments, the radiating plate is disposed so that an object disposed in the enclosure for heating rests below the radiating plate. In some embodiments, the radiating plate is disposed so that an object disposed in the enclosure for heating rests to one side of the radiating plate. A further radiating plate as described above may be disposed so that an object disposed in the enclosure for heating rests between the radiating plate and the further radiating plate. The radiating plate may be disposed inside the enclosure or may form a portion of a wall of the enclosure.

In some embodiments, an empty enclosure efficiency of the antenna is less than −6 dB, although it may be less than −8, −10, −15, −20, −25, or −30 dB. The empty enclosure efficiency is a ratio of power not returned from the radiating plate to power fed to the radiating plate at the test frequency when the enclosure is empty, that is when no object to be heated is in the enclosure.

In some embodiments, the apparatus comprises a controller coupled to the source to control the source based on feedback received from the radiating plate. The apparatus may be configured to control the source based on feedback received from the radiating plate to increase the contact efficiency. The controller may be configured to change one of frequency;

phase between signals supplied to a pair of feeding ports;

amplitude of signal supplied to one feeding port relative to another feeding port;

frequency, and phase between signals supplied to a pair of feeding ports;

frequency, and amplitude of signals supplied to one feeding port relative to another feeding port;

frequency, phase between signals supplied to a pair of feeding ports, and amplitude of signals supplied to one feeding port relative to another feeding port; and phase between signals supplied to a pair of feeding ports, and amplitude of signals supplied to one feeding port relative to another feeding port, In some embodiments, the control causes increase in the contact efficiency or otherwise improves the heating, e.g., by improving the heating uniformity.

In some embodiments, the microwave power source comprises switches to selectively couple one or more feeds of the radiating plate to the microwave power source and the controller is configured to control the switches in response to feedback. For example, the switches may be controlled to increase the contact efficiency in response to the feedback. The controller may be or include a processing device, programmed to execute operations that result in the control.

In some embodiments, the apparatus comprises a secondary heating arrangement. The controller may be arranged to cause heating of the load using the secondary heating arrangement until the contact efficiency is estimated to have risen above a threshold value and to cause heating of the load using the radiating plate once the contact efficiency is estimated to have risen above the threshold value. It will be understood that the contact efficiency may be estimated in any suitable way, for example based on measurement of input and output powers and/or scattering coefficients, for example, as described in detail below.

The secondary heating arrangement may comprise a microwave heating arrangement, for example microwave cavity housing the radiating plate and a separate antenna, separate from the radiating plate. The separate antenna may be fed by a separate source, for example a magnetron. Alternatively, or additionally, the separate antenna may be fed by the same source as the radiating plate.

In some embodiments, the secondary heating arrangement may comprise a convection heater for causing circulation of heated air around the object.

In some embodiments, the secondary heating arrangement may be a resistive or inductive heating arrangement comprising a resistive or inductive heating element.

The heating element may be embedded in the radiating plate. For example, the heating element may be embedded in the dielectric layer. Where the one or more radiating elements are printed on a support, the heating element may be printed on the same support.

In some embodiments, a method of making a radiating plate for heating a range of loads with microwaves having a range of working frequencies is provided. The radiating plate has a radiating element and a ground plate parallel to the radiating element. The method comprises selecting a shape of the radiating element and sizing the radiating element based on a central frequency of the range of working frequencies and in accordance with a dielectric constant characteristic of the range of loads. The method further comprises optimising the shape and size and making a radiating plate having a radiating element of the optimised shape and size.

In some embodiments, optimising the shape and size may comprise optimising the shape and size to decrease free space radiation efficiency of the radiating plate at the central working frequency. In some embodiments, optimising the shape and size may comprise optimising the shape and size to increase the number of electric field distributions obtainable within the range of working frequencies in a load within the range of loads. In some embodiments, optimising the shape and size may comprise optimising the shape and size to increase the number of field maxima at the surface of the radiating plate without a load. In some embodiments, optimising the shape and size may comprise optimising the shape and size to increase propagation of electric fields within the load in contact with the radiating plate. In some embodiments, optimising the shape and size may comprise optimising the shape and size to increase decay of electric fields outside of the load in contact with the radiating plate. In some embodiments, optimising the shape and size may comprise optimising the shape and size to increase the number of resonance frequencies within the range of working frequencies of a system comprising the radiating plate and a load within the range of loads. It will be understood that in various embodiments any combination of these factors are optimised.

It will be understood that the designer sets out about designing a radiating plate according to the above process by selecting a desired range of working frequencies based on criteria such as the type of source available and regulatory aspects, for example. Typically, the range of loads will be chosen based on the desired application for the radiating plate, for example the range of loads may encompass typical foodstuffs at refrigerator and/or room temperature, for example vegetables, meat, pasta, rice, combination of such foodstuffs, etc. The range of loads may also include, for example, water at various temperatures and/or frozen foodstuffs, for example of the kind just described.

In some embodiments, in particular if it is decided that a single radiating element does not cover a sufficient area for the application at hand, an array of radiating elements of optimised shape and size may be designed such that coupling between the radiating elements in the array is minimised. Making the radiating plate may comprise making the radiating plate having a plurality of radiating elements arranged in accordance with the designed array. In some embodiments, each radiating element is electrically isolated from the other radiating elements. In such embodiments, in particular, minimising coupling may comprise manipulating mutual orientations and distances of the radiating elements. In some embodiments, each radiating element is electrically connected to the other radiating elements and minimising coupling may comprise including respective chokes or current barriers between the radiating elements in the array and/or manipulating mutual orientations and distances.

It will be understood that, in some embodiments, the radiating plate designed by the process described above may be a radiating element as described further above.

In further embodiments and aspects, there is provided a radiating plate configured to be fed with feed signals having a range of microwave working frequencies, the radiating plate comprising a ground plate and one or more radiating elements spaced therefrom by a dielectric layer, wherein the radiating elements are configured to resonate at a working frequency in a medium having a dielectric constant in the range of 20 to 60 and a loss tangent in the range of 0.1 to 0.5. In some embodiments, the radiating plate is further configured and arranged as set out above.

In yet further embodiments and aspects, there is provided an energy application apparatus comprising a radiating plate in accordance with any of the embodiments described above and a microwave power source coupled to the radiating plate and configured to feed the radiating plate at one or more frequencies within the range of working frequencies.

The following aspects and embodiments are also disclosed:

1. An apparatus, optionally as described above, for heating a load with microwave energy at frequencies wherein the load's dielectric constant is within a predetermined range, the apparatus comprising:

a microwave power source configured to supply microwave energy at said frequencies; and a radiating plate comprising:

an electrically conductive structure comprising a plurality of radiating elements; and a feeding port, connecting the electrically conductive structure to the microwave power source, wherein the radiating plate is configured so that most of the power fed from the microwave source through the feeding port returns towards the power source when no load is contacting the radiating plate, and most of the power fed from the microwave source through the feeding port is absorbed by the load to be heated by the apparatus when the load is contacting the radiating plate, even in absence of a microwave cavity that encloses the radiating plate and the load.

2. An apparatus according to item 1, wherein the radiating plate comprises a conductive base plate, and the electrically conductive structure is separated from the conductive base plate by a dielectric layer.

3. An apparatus according to item 2, wherein the electrically conductive structure is printed on the dielectric layer.

4. An apparatus according to any one of the preceding items, further comprising a microwave cavity enclosing the radiating plate, and sized to receive therein the load.

5. An apparatus according to item 4, wherein said frequencies are below the lowest resonance frequency of the microwave cavity when the microwave cavity is empty.

6. An apparatus according to item 4 or 5, further comprising a second microwave power source, said second microwave power source comprising a magnetron, configured to heat the load by radiating into the microwave cavity at magnetron frequencies.

7. An apparatus according to item 6, wherein the magnetron frequencies are above the lowest resonance frequency of the microwave cavity when the microwave cavity is empty.

8. An apparatus according to any one of items 2 to 7, wherein the dielectric layer separating between the base plate and the electrically conductive structure has, at the frequencies, dielectric loss (tan δ) smaller than 0.05.

9. An apparatus according to item 1 to 8, wherein the radiating plate comprises a plurality of feeding ports.

10. An apparatus according to item 9, comprising a choke configured to reduce coupling between two of said feeding ports.

11. An apparatus according to any one of the preceding items, wherein the radiating plate comprises a second dielectric layer, covering the electrically conductive structure.

12. An apparatus according to item 11, wherein the second dielectric layer has a dielectric loss (tan δ) smaller than 0.05.

13. An apparatus according to any one of items 1 to 12, further comprising a processor configured to improve the matching between the power source and the radiating plate in presence of the load.

14. An apparatus according to item 13, further comprising a detector configured to provide the processor with signals indicative of the matching, and wherein the processor is configured to provide the microwave power source with control signals based on the signals received from the detector.

15. An apparatus according to any one of items 9 to 14, comprising a switching mechanism configured to connect and disconnect at least two of the RF feeding ports from the microwave power source independently of each other.

16. An apparatus according to item 15, wherein the switching mechanism is controlled by a processor configured to receive signals indicative of the matching, and send to the switching mechanism control signals based on the signals indicative of the matching.

17. An apparatus according to any one of items 1 to 16, further comprising an additional heater, configured to heat the load when the load is on the radiating plate.

18. An apparatus according to item 17, comprising a processor configured to switch between the additional heater and the microwave power source, so that the conventional heater is activated when the dielectric constant of the load is outside the predetermined range, and the microwave power source is activated mainly when the dielectric constant of the load is inside the predetermined range.

19. An apparatus according to item 17, comprising a processor configured to switch between the conventional heater and the microwave power source, so that the conventional heater is activated when the microwave source and the load are poorly matched, and the microwave power source is activated mainly when the microwave power source and the load are well matched.

20. An apparatus according to any one of items 1 to 19, wherein the predetermined range of dielectric constants is between 20 and 60.

21. An apparatus according to any one of items 1 to 20, further comprising means for manipulating the matching between the power source and the radiating plate.

22. A radiating plate, comprising:

an electrically conductive base plate;

an electrically conductive structure comprising a plurality of radiating elements;

a dielectric layer separating between the electrically conductive base plate and the electrically conductive structure, and a feeding port, configured to connect the electrically conductive structure to a microwave power source.

23. A radiating plate according to item 22, wherein the feeding port is configured to connect the electrically conductive structure to the microwave power source through a coaxial waveguide.

24. A radiating plate according to item 22 or 23, wherein the dielectric layer has a dielectric loss (tan δ) smaller than 0.05 at least at frequencies between 902 MHz and 928 MHz.

25. A radiating plate according to item 22 or 23, wherein the dielectric coating has a dielectric loss (tan δ) smaller than 0.05 at least at frequencies between 2400 MHz and 2500 MHz.

26. A radiating plate according to any one of items 22 to 25, comprising a plurality of feeding ports.

27. A radiating plate according to item 26, comprising a choke configured to reduce coupling between two of the feeding ports.

28. A radiating plate according to item 27, wherein the choke is printed on the dielectric layer.

29. A method of cooking a food item by an apparatus comprising a microwave power source; a radiating plate; and a feeding port connecting the radiating plate to the microwave power source, wherein the food item is frozen before cooking begins, the method comprising:

elevating the temperature of the food item until the microwave power source is well matched to the food item; and when the microwave power source is well matched to the food item, activating the microwave power source to heat the food item.

30. A method according to item 29, wherein elevating the temperature of the food item is by the apparatus.

31. A method according to item 30, wherein the apparatus comprises at least one of: a magnetron that is not connected to the radiating plate by a feeding port, a convection heater, and an IR heater.

32. A method according to any one of items 29 to 31, further comprising:

receiving feedback indicative of the matching between the microwave power source and the frozen food item; and selecting excitation setups for heating the load based on the feedback.

33. A method according to item 32, wherein receiving feedback comprises receiving through the feeding port.

34. A method according to any one of items 29 to 33, wherein the apparatus for heating the load is according to any one of items 1 to 21.

35. A method according to any one of items 29 to 34, wherein the radiating plate is according to any one of items 22 to 28.

The following further aspects and embodiments are also disclosed:

1. An apparatus, optionally as itemized and/or described above, for heating a load with microwave energy at working frequencies, at which the load's dielectric constant is within a predetermined range, the apparatus comprising:

a solid state microwave power source configured to supply microwave energy at said working frequencies;

a conductive base plate;

a flat radiating element substantially parallel to the conductive base plate and electrically isolated from the conductive base plate; and a feeding port, connecting the flat radiating element to the solid state microwave power source, wherein the apparatus is configured so that most of the power supplied from the microwave source to the feeding port returns towards the power source when no load is contacting the radiating element and most of the power supplied from the microwave source to the feeding port is absorbed by the load when the load is contacting the radiating element, even in absence of a microwave cavity that encloses the radiating plate and the load.

2. An apparatus according to item 1, comprising a radiating plate that includes the flat radiating element and the feeding port.

3. An apparatus according to item 2, wherein the radiating plate comprises a transmission line connecting the flat radiating element to the feeding port.

4. An apparatus according to any one of the preceding items, wherein the flat radiating element is isolated from the conductive base plate by air.

5. An apparatus according to any one of the preceding items, wherein the flat radiating element is isolated from the conductive base plate by a dielectric layer.

6. An apparatus according to 5, wherein the flat radiating element is printed on the dielectric layer.

7. An apparatus according to any one of the preceding items, further comprising a microwave cavity enclosing the flat radiating element, and sized to receive therein the load.

8. An apparatus according to item 7, wherein said working frequencies are below the lowest resonance frequency of the microwave cavity when the microwave cavity is empty.

9. An apparatus according to item 7 or 8, further comprising a second microwave power source, said second microwave power source comprising a magnetron, configured to heat the load by radiating into the microwave cavity at magnetron frequencies.

10. An apparatus according to item 9, wherein the magnetron frequencies are above the lowest resonance frequency of the microwave cavity when the microwave cavity is empty.

11. An apparatus according to any one of the preceding items, wherein the flat radiating element is isolated from the conductive base plate by a dielectric layer having, at the working frequencies, dielectric loss (tan δ) smaller than 0.05.

12. An apparatus according to any one of the preceding items, comprising a plurality of flat radiating elements.

13. An apparatus according to item 12, wherein the radiating plate comprises the plurality of flat radiating elements.

14. An apparatus according to item 13, wherein the radiating plate comprises a transmission line connecting at least one flat radiating element from the plurality of flat radiating elements to the feeding port.

15. An apparatus according to any one of items 12 to 14, wherein the plurality of flat radiating elements have a common conductive base plate.

16. An apparatus according to any one of items 12 to 15, comprising a plurality of feeding ports.

17. An apparatus according to item 16, wherein each feeding port of said plurality of feeding ports feeds a different flat radiating element.

18. An apparatus according to item 17 or 18, comprising a choke configured to reduce coupling between two of said feeding ports.

19. An apparatus according to any one of the preceding items, comprising a second dielectric layer, covering the flat radiating elements.

20. An apparatus according to item 19, wherein the second dielectric layer has a dielectric loss (tan δ) smaller than 0.05.

21. An apparatus according to any one of items 1 to 19, further comprising a processor configured to improve the matching between the solid state microwave power source and the radiating plate in presence of the load.

22. An apparatus according to item 21, further comprising a detector configured to provide the processor with signals indicative of the matching, and wherein the processor is configured to provide the solid state microwave power source with control signals based on the signals received from the detector.

23. An apparatus according to any one of items 16 to 22, comprising a switching mechanism configured to connect and disconnect at least two of the RF feeding ports from the solid state microwave power source independently of each other.

24. An apparatus according to item 23, wherein the switching mechanism is controlled by a processor configured to receive signals indicative of the matching, and send to the switching mechanism control signals based on the signals indicative of the matching.

25. An apparatus according to any one of items 1 to 24, further comprising an additional heater, configured to heat the load when the load is in contact with the radiating element.

26. An apparatus according to item 254, comprising a processor configured to switch between the additional heater and the solid state microwave power source, so that the conventional heater is activated when the dielectric constant of the load is outside the predetermined range, and the microwave power source is activated mainly when the dielectric constant of the load is inside the predetermined range.

27. An apparatus according to item 25, comprising a processor configured to switch between the conventional heater and the microwave power source, so that the conventional heater is activated when the microwave source and the load are poorly matched, and the microwave power source is activated mainly when the microwave power source and the load are well matched.

28. An apparatus according to any one of items 1 to 27, wherein the predetermined range of dielectric constants is between 20 and 60.

29. An apparatus according to any one of items 1 to 28, further comprising means for manipulating the matching between the power source and the radiating plate.

30. A radiating plate, comprising:

an electrically conductive base plate;

an electrically conductive structure comprising a plurality of flat radiating elements, each of said radiating elements being substantially parallel to the electrically conductive base plate;

a dielectric layer separating between the electrically conductive base plate and the electrically conductive structure, and a feeding port, configured to connect the electrically conductive structure to a microwave power source.

31. A radiating plate according to item 30, wherein the feeding port is configured to connect the electrically conductive structure to the microwave power source through a coaxial waveguide.

32. A radiating plate according to item 30 or 31, wherein the dielectric layer has a dielectric loss (tan δ) smaller than 0.05 at least at frequencies between 902 MHz and 928 MHz.

33. A radiating plate according to item 30 or 31, wherein the dielectric coating has a dielectric loss (tan δ) smaller than 0.05 at least at frequencies between 2400 MHz and 2500 MHz.

34. A radiating plate according to any one of items 30 to 33, comprising a plurality of feeding ports.

35. A radiating plate according to item 34, comprising a choke configured to reduce coupling between two of the feeding ports.

36. A radiating plate according to item 35, wherein the choke is printed on the dielectric layer.

37. A method of cooking a food item by an apparatus comprising a microwave power source; a radiating plate; and a feeding port connecting the radiating plate to the microwave power source, wherein the food item is frozen before cooking begins, the method comprising:

elevating the temperature of the food item until the microwave power source is well matched to the food item; and when the microwave power source is well matched to the food item, activating the microwave power source to heat the food item.

38. A method according to item 37, wherein elevating the temperature of the food item is by the apparatus.

39. A method according to item 38, wherein the apparatus comprises at least one of: a magnetron that is not connected to the radiating plate by a feeding port, a convection heater, and an IR heater.

40. A method according to any one of items 37 to 39, further comprising:

receiving feedback indicative of the matching between the microwave power source and the frozen food item; and selecting excitation setups for heating the load based on the feedback.

41. A method according to item 40, wherein receiving feedback comprises receiving through the feeding port.

42. A method according to any one of items 37 to 41, wherein the apparatus for heating the load is according to any one of items 1 to 29.

43. A method according to any one of items 37 to 42, wherein the radiating plate is according to any one of items 30 to 36.

Some exemplary aspects of the invention may include an apparatus for heating a load with microwave energy at working frequencies, at which the load's dielectric constant is within a predetermined range. The apparatus may comprise a solid state microwave power source configured to supply microwave energy at said working frequencies; a conductive base plate; a flat radiating element substantially parallel to the conductive base plate and electrically isolated from the conductive base plate; and a feeding port, connecting the flat radiating element to the solid state microwave power source.

In some embodiments, the apparatus is configured so that most of the power supplied from the microwave source to the feeding port returns towards the power source when no load is contacting the radiating element and most of the power supplied from the microwave source to the feeding port is absorbed by the load when the load is contacting the radiating element. In some embodiments, this may be the case even in absence of a microwave cavity that encloses the radiating plate and the load.

In some embodiments, the apparatus may include a radiating plate that includes the flat radiating element and the feeding port. The radiating plate may also comprise a transmission line connecting the flat radiating element to the feeding port.

In some embodiments, the flat radiating element may be isolated from the conductive base plate by air.

In some embodiments, the flat radiating element may be isolated from the conductive base plate by a dielectric layer In some embodiments, the flat radiating element may be printed on the dielectric layer.

In some embodiments, the dielectric layer has, at the working frequencies, dielectric loss (tan δ) smaller than 0.01.

In some embodiments, the apparatus may also include a microwave cavity enclosing the flat radiating element, and sized to receive therein the load.

In some embodiments, the apparatus includes a plurality of flat radiating elements.

In some embodiments, the radiating plate comprises the plurality of flat radiating elements.

In some embodiments, the radiating plate comprises a transmission line connecting at least one flat radiating element from the plurality of flat radiating elements to the feeding port.

In some embodiments, the plurality of flat radiating elements have a common conductive base plate.

In some embodiments, the apparatus may include a plurality of feeding ports.

In some embodiments, each feeding port of the plurality of feeding ports feeds a different flat radiating element.

In some embodiments, the apparatus may include a second dielectric layer, covering the flat radiating element.

Some exemplary aspects of the invention may be directed to an apparatus for heating a load with microwave energy at frequencies wherein the load's dielectric constant is within a predetermined range. The predetermined range may be, for example, between 20 and 60. The apparatus may include:

a microwave power source configured to supply microwave energy at said frequencies; and a radiating plate comprising:

an electrically conductive structure comprising a plurality of radiating elements; and a feeding port, connecting the electrically conductive structure to the microwave power source. The radiating plate may be configured so that most of the power fed from the microwave source through the feeding port returns towards the power source when no load is contacting the radiating plate, and most of the power fed from the microwave source through the feeding port is absorbed by the load to be heated by the apparatus when the load is contacting the radiating plate, even in absence of a microwave cavity that encloses the radiating plate and the load.

In some embodiments, the radiating plate comprises a conductive base plate, and the electrically conductive structure is separated from the conductive base plate by a dielectric layer. The electrically conductive structure may be printed on the dielectric layer.

In some embodiments, the apparatus may include a microwave cavity enclosing the radiating plate, and sized to receive therein the load. When empty, the microwave cavity may have a lowest resonance frequency that is higher than any of the frequencies, at which the apparatus is to heat the load.

In some embodiments, the apparatus may also include a second microwave power source. The second microwave power source may include a magnetron. In some embodiments, no transmission line connects between the magnetron of the second microwave power source and the radiating plate. The magnetron may be configured to heat the load by radiating into the microwave cavity at magnetron frequencies. The magnetron frequencies may be above the lowest resonance frequency of the empty microwave cavity.

In some embodiments, the dielectric layer separating between the base plate and the electrically conductive structure has, at least at the frequencies used for heating the load by the microwave power source connected to the radiating plate through the feeding port, dielectric loss (tan δ) smaller than 0.05.

In some embodiments, the radiating plate comprises a plurality of feeding ports. In some embodiments, the radiating plate may include a choke configured to reduce coupling between two of said feeding ports.

In some embodiments, the radiating plate may include a second dielectric layer, covering the electrically conductive structure. The second dielectric layer may have a dielectric loss (tan δ) smaller than 0.05.

In some embodiments, the apparatus may include means for manipulating the matching between the power source and the radiating plate. For example, the apparatus may include a processor configured to improve the matching between the power source and the radiating plate in presence of the load. Such apparatus may include a detector, configured to provide the processor with signals indicative of the matching. The processor may be configured to provide the microwave power source with control signals based on the signals received from the detector. As another example, the apparatus may include a switching mechanism, configured to connect and disconnect at least two of the RF feeding ports from the microwave power source independently of each other. The switching mechanism may be controlled by a processor configured to receive signals indicative of the matching, and send to the switching mechanism control signals based on the signals indicative of the matching.

In some embodiments, the apparatus may include an additional heater, configured to heat the load when the load is on the radiating plate. In some embodiments, the apparatus may include a processor configured to switch between the additional heater and the microwave power source. For example, the processor may be configured to control the apparatus so that the conventional heater is activated when the dielectric constant of the load is outside the predetermined range, and the microwave power source is activated mainly when the dielectric constant of the load is inside the predetermined range. In some embodiments, the processor may be configured to switch between the conventional heater and the microwave power source, so that the conventional heater is activated when the microwave source and the load are poorly matched, and the microwave power source is activated mainly when the microwave power source and the load are well matched.

An aspect of some embodiments of the invention may include a radiating plate. The radiating plate may include:

an electrically conductive base plate;

an electrically conductive structure comprising a plurality of radiating elements;

a dielectric layer separating between the electrically conductive base plate and the electrically conductive structure, and a feeding port, configured to connect the electrically conductive structure to a microwave power source. In some embodiments, each of the radiating elements is flat, and substantially parallel to the electrically conductive base plate. In some embodiments, the radiating plate may be as described hereinabove.

In some embodiments, the feeding port may be configured to connect the electrically conductive structure to the microwave power source through a coaxial waveguide.

In some embodiments, the dielectric layer has a dielectric loss (tan δ) smaller than 0.05 at least at frequencies between 902 MHz and 928 MHz, or at least at frequencies between 2400 MHz and 2500 MHz.

In some embodiments, the radiating plate includes a plurality of feeding ports. A choke configured to reduce coupling between two of the feeding ports may also be included in a radiating plate according to some embodiments. The choke may be printed on the dielectric layer.

An aspect of some embodiments of the invention may include a method of cooking a food item by an apparatus comprising a microwave power source; a radiating plate; and a feeding port connecting the radiating plate to the microwave power source. In some embodiments, the apparatus may be as described above. The food item may be frozen before cooking begins. The method includes:

elevating the temperature of the food item until the microwave power source is well matched to the food item; and when the microwave power source is well matched to the food item, activating the microwave power source to heat the food item. Elevating the temperature of the food item may be by the apparatus. For example, the apparatus may include at least one of: a magnetron that is not connected to the radiating plate by a feeding port, a convection heater, and an IR heater.

In some embodiments, the method may further include receiving feedback indicative of the matching between the microwave power source and the frozen food item; and selecting excitation setups for heating the load based on the feedback. Receiving the feedback may include receiving through the feeding port.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the methods described herein can involve performing or completing selected tasks manually, automatically, or a combination thereof. Moreover, several selected tasks could be implemented by hardware, by software or by firmware or by a combination thereof using an operating system.

For example, hardware for performing selected tasks could be implemented as a chip or a circuit. As software, selected tasks could be implemented as a plurality of software instructions being executed by a computer using any suitable operating system. In some embodiments, one or more tasks described herein are performed by a processor, such as a computing platform for executing a plurality of instructions. The processor may include a volatile memory for storing instructions and/or data. Additionally or alternatively, the processor may include a non-volatile storage, for example, a magnetic hard-disk and/or removable media, for storing instructions and/or data. In some embodiments, a network connection may be provided as well. A display and/or a user input device such as a keyboard or mouse may also be provided.

The drawings and detailed description which follow contain numerous alternative examples consistent with the invention. A summary of every feature disclosed is beyond the object of this summary section. For a more detailed description of exemplary aspects of the invention, reference should be made to the drawings, detailed description, and claims, which are incorporated into this summary by reference.

BRIEF DESCRIPTION OF THE DRAWINGS

Some embodiments of the invention are herein described, by way of example only, with reference to the accompanying drawings. With specific reference now to the drawings, it is stressed that the particulars shown are by way of example and for purposes of illustrative discussion of embodiments of the disclosed apparatuses and methods. In this regard, the description taken with the drawings makes apparent to those skilled in the art how embodiments of the disclosed apparatuses and methods may be practiced.

In the drawings.

DETAILED DESCRIPTION

Figure 1:
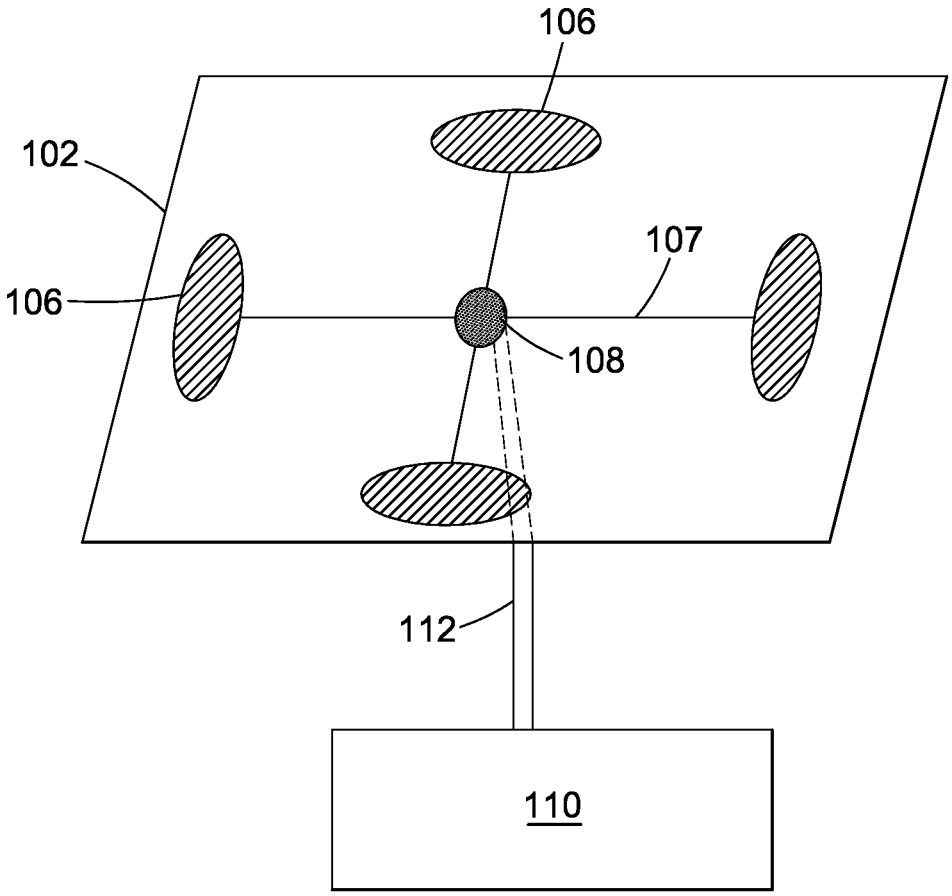
FIG. 1 is a diagrammatic illustration of an apparatus for heating a load with microwave energy.

An aspect of the present disclosure relates to an apparatus for heating a load with microwave energy. The load may be characterized by dielectric constant values that lie within a predetermined range, at least at some given frequencies. The heating may be at frequencies wherein the load's dielectric constant is within the predetermined range (herein referred to "working frequencies"). Loads having dielectric constants outside the predetermined range may be heated to some extent, but less efficiently than loads having their dielectric constants within the predetermined range. In some embodiments, loads having dielectric constants similar to those of air or vacuum are not heated at all.

In some embodiments, the apparatus includes a microwave power source and a radiating plate. The microwave power source may be configured to supply microwave energy at the above-mentioned working frequencies and the radiating plate may include an electrically conductive structure and a feeding port. The feeding port may connect the electrically conductive structure to the microwave power source. The feeding port may be, for example, a coaxial feeding port or a microstrip feeding port. The electrically conductive structure may include one or more radiating elements. In some embodiments, the electrically conductive structure may also include one or more transmission lines, for example a transmission line connecting a radiating element to a feeding port. In some embodiments, the radiating plate consists essentially of the radiating element and feeding port.

The apparatus, and particularly the radiating plate, may be so configured, that most of the power fed to the feeding port from the microwave power source returns towards the microwave power source in absence of a load. This may be referred to herein as poor matching between the radiating plate and the load. Similarly poor matching may exist between the radiating plate and a load contacting the radiating plate, if the load's dielectric constant is outside the predetermined range, for example, if the predetermined range is between 20 and 60, and the dielectric constant of the load is about 1-5. However, the microwave power source and the load may be well matched when a load with dielectric constant within the predetermined range is contacting the radiating plate. This dependence of the matching (and accordingly also of heating efficiency) on the existence (or kind) of a load may be independent on the dimensions, or even on the very existence of a microwave cavity enclosing the radiating plate and the load. For example, this dependence may exist even in absence of a microwave cavity that encloses the radiating plate and the load.

In the present description and claims, a load is considered to contact the radiating plate if there is physical contact (i.e., touch) between the two. In some embodiments, contact may exist in absence of touching, provided the load is separated from the radiating plate by only a very short distance of up to about 3 mm. Such separation, however, may cause the heating to be less efficient than can be achieved with a load that touches the radiating plate.

The term heating a load may be used herein for any action of causing energy to be absorbed in the load, whether accompanied by temperature raise, or not. Temperature raise may occur, for example, during cooking; while energy absorbance with no temperature raise may occur, for example, during thawing. Under some circumstances, heating may even be accompanied by temperature decrease, for example, during some drying processes.

The load to be heated by the apparatus may include any object or number of objects. The term object is not necessarily limited to any particular form: an object may include a liquid, semi-liquid, solid, semi-solid, composite materials, mixtures of matter of differing phases, etc. In some embodiments, the load may include one or more food items to be cooked, defrosted, baked, re-heated, or otherwise processed. In some embodiments, the heating is most efficient with loads having thickness that do not exceed much beyond the penetration depth into the load of electromagnetic radiation of the frequencies used for heating. For example, efficient heating may be obtained with loads having thickness (extending perpendicularly to the radiating plate), up to 10%, 15%, or 20% larger than the penetration depth. Loads of smaller thickness may also be heated efficiently. While the apparatus is configured to heat the load, it may happen in some embodiments that objects other than the load may be heated. For example, in some embodiments the apparatus may include a dielectric layer, on which an electrically conductive structure (e.g., the radiating structure) is printed, and this dielectric layer may be heated, reducing the energetic efficiency of the device, as some RF energy may be spent on heating the dielectric layer rather than on heating the load. In another example, the matching between the load and the radiating plate may be less than perfect, and some microwave energy may return to the microwave power source and heat it. Nevertheless, it is preferred that most of the microwave energy going out of the microwave power source is absorbed in the load itself. In some embodiments, more than half, more than two thirds, or even more than 80% of the microwave energy supplied by the microwave source may be absorbed by the load.

The term microwave energy refers to energy deliverable by electromagnetic radiation at the microwave frequency range. The microwave frequency range is between 300 MHz and 300 GHz. In some embodiments, however, only one or more portions of this range may be utilized for heating, for example, some embodiments may use only frequencies in the range of 800 MHz to 1000 MHz, 1.5 GHz to 5 GHz, 300 MHz to 3 GHz, etc. In some embodiments, only frequencies dedicated by the regulatory authorities for industrial, scientific, or medical use (also known as ISM frequency bands) may be used, for example, the band between 902 MHz and 928 MHz, the band between 2400 MHz and 2500 MHz, and so on.

The apparatus may be configured to heat the load at frequencies wherein the load's dielectric constant is within a predetermined range.

The term dielectric constant is used to refer to the real part of the relative permittivity, frequently denoted in the literature by $\varepsilon_r$. Generally, the dielectric constant changes with frequency. The dielectric constant of an object may depend on the temperature of the object. Loads of different dielectric constants may be referred to herein as different loads, whether the difference in dielectric constant is due to different constitution or temperature. The apparatus may be configured to heat loads having dielectric constant within a predetermined range, for example, by using frequencies at which the dielectric constant of the load is within this range. While loads having dielectric constant outside the predetermined range may be heated, such heating may be inefficient, while efficient heating (e.g., where more than 70%, 80%, or 90% of the energy supplied by the microwave power source is absorbed in the load) may be achieved only with loads having a dielectric constant within the predetermined range. Different apparatuses may be configured to heat loads having dielectric constants at different predetermined ranges. For example, some apparatuses for general purpose cooking may be configured to heat loads having dielectric constants between about 20 and about 60 or 80. Some apparatuses may be configured to heat objects of more specified nature (e.g., dedicated apparatuses for boiling water), having dielectric constants at a narrower range (e.g., between 60 and 80). The dielectric constant may also change with temperature, and the apparatus may be configured to heat certain loads within a first temperature range, and other loads within a second, different, temperature range, in accordance with the dielectric constant of the loads at the relevant temperature ranges, and the dielectric constant predetermined range, at which the apparatus is configured to heat efficiently.

As mentioned above, the apparatus may include a microwave power source and a radiating element, which may be part of a radiating plate.

The microwave power source may be configured to supply microwave power at the frequencies, at which the load has its dielectric constant within the predetermined range, also referred herein as working frequencies. As used herein, the term microwave power source refers generally to a device that outputs electric signals at the microwave frequency range and at a power suitable for heating the load. The power may be, in some embodiments, high power, for example, more than 50 W. For example, some microwave power sources may supply microwaves at powers of 100 W, 200 W, 500 W, 1000 W, 2000 W, or any intermediate power level. In some embodiments, the microwave power source may include a solid state power source, e.g., a solid state oscillator and/or a solid state amplifier. Solid state power sources may facilitate control over frequency, phase, and amplitude of the signals outputted from the power source, and this may allow improvement of the matching between the power source and the load, e.g., by tuning the frequency to that which is best absorbed by the load. Thus, a microwave power source may include a frequency selector (e.g., a voltage controlled oscillator), a phase selector (e.g., a phase shifter), and amplitude selector (e.g., voltage controlled attenuator). In some embodiments, two or more of these selectors may be embodied in a single device, for example a direct digital synthesizer (DDS), which is configured to generate signals of predetermined frequency, phase, and amplitude.

In some embodiments, microwave power is fed into the load through two or more feeding ports. In some such embodiments, the microwave power source may allow control over a phase difference between two waves emitted through two different ports; two phase differences between three waves emitted through three different ports, etc. Additionally, or alternatively, the microwave power source may allow control over amplitude ratios between waves emitted through different ports, for example, one amplitude ratio between waves emitted through two different ports, two amplitude ratios between waves emitted through three different ports, etc. While phase differences and amplitude ratios are most conveniently used, in some embodiments, the microwave power source may allow control over other relations between phases and amplitudes, e.g., amplitude difference, phase ratios, or the absolute value of each phase, and/or the absolute value of each amplitude.

The term excitation setup may be used herein to refer to a set of values of controllable variables that may affect the matching to the load. The variables themselves (e.g., frequency, phase differences, and amplitude ratios) may be referred to as controllable match affecting variables, or c-MAVs. The match affecting variables may be controllable by the apparatus. It will be understood that any of the following may be controlled: frequency; phase; amplitude ratios; frequency and phase; frequency and amplitude ratios; amplitude ratios and phase; or frequency, amplitude ratios and phase.

In some embodiment, the apparatus comprises a processor configured to set the excitation setups at which the energy is applied to the load. In some embodiments, the processor controls the source to sweep over excitation setups, for example by sweeping over frequencies and phase differences. In some such embodiments, the sweep may be at a constant step size (e.g., at 1 MHz steps along the frequency dimension, at 10° steps along a phase difference dimension, etc.). In some embodiments, the steps may be of varying size, for example, the frequency may change at 1 MHz steps at one range of working frequencies, and at 2.5 MHz at another range of working frequencies. In some embodiments, the sizes of the steps taken during sweeping are pre-programmed into the processor. In some embodiments, the processor may receive the step sizes from a memory, which may be integral with, outside of, or remote from the processor. In some embodiments, the memory may store several sets of step sizes, and the processor may select between them based on input from an input interface. For example, the apparatus may include a user interface configured to allow the user to define the step sizes. In some embodiments, the apparatus may include a user interface allowing the user to indicate the type of the load, and the processor may select the step size accordingly, for example, using a lookup table associating load types with step sizes. In some embodiments, the apparatus may include a reader for reading machine readable elements, such as barcodes and RFID tags, that may be associated with the load. In some such embodiments, the step size may be set based on data read from the machine readable element. For example, the machine readable element may carry data indicative of the load type, and obviate the need for the user to enter the load type. In some embodiments, the machine readable element may include data indicative of the step sizes. In some embodiments, the machine readable element may include data that allows the processor to access a remote memory and obtain from the remote memory step seizes appropriate for the load associated with the machine readable element.

In some embodiments, the excitation setups of a sweep may be predetermined as a list of excitation setups, rather than as step sizes. The list of excitation setups may be pre-programmed into the processor or received through an input similarly to step sizes as described above.

In some embodiments, the apparatus includes detectors, e.g. as a part of the microwave power source. The detectors may be configured for estimating the matching to the load, e.g. at each excitation setup. Each feeding port may be connected to a detector through a coupler, configured to couple to the detector signals going backwards (from the feed) or forward (towards the feed). In some embodiments, the coupler may include a dual directional coupler, a circulator, and/or any other arrangement configured to differentiate between signals going forward and backward. The information retrieved by the detector(s) may be used for improving the match, for example, by tuning the excitation setup (by tuning the value of one or more controllable match affecting variables) to reduce the returned power being detected, for example by tuning to or selecting that excitation setup at which the least returned power is detected. In some embodiments, the microwave power source may further include a processor, configured to receive input from the detector, and, based on this input, control the power source to the excitation setup or setups at which energy is supplied to the load or send instructions for setting the excitation setups at which energy is applied to the load to the power source or a controller controlling the power source. As used herein, the term detector may include any circuit and/or device configured to measure voltage and/or current at a feeding port, e.g., voltage and/or current of RF signals going through the feeding port towards the load or towards the source. Optionally, or alternatively, a detector may include any circuit and/or device configured to measure a ratio (or difference) between two input signals, e.g., ratio between amplitudes of two signals and/or differences between phases of two signals. For example, the detector or detectors employed in an apparatus for heating a load as described herein may include passive detectors, active detectors, power meters, phase detectors, log detectors, and/or ratio detectors (e.g. of amplitudes and/or power). Such arrangement may allow the detector to provide the amount of information required for estimating the quality of the matching, for example for estimating S parameters, Gamma parameters, and/or dissipation ratios (all discussed below). The information required for estimating the quality of the matching may be provided by a single detector, connected to a different feeding port at a time, e.g., through a switching mechanism. The switching mechanism may include high power switches, arranged between the microwave power source and the feeding ports to switch each feeding port on (i.e. to connect it to the microwave power source) or off. In some embodiments, the switches may be positioned between the signal generator and the power amplifier. In some embodiments, the microwave power source may include the switching mechanism. In some embodiments, the information required for estimating the quality of the matching may be provided by a plurality of detectors, each connected permanently to one of the feeding ports. In some embodiments, a single detector may be used for all feeding ports. For example, each feeding port may be connected to a switching mechanism (e.g., a multiplexer), and the switching mechanism may connect each time another one (or two) of the feeding ports to the detector. In some embodiments, several detectors may be used, each for detecting voltages and/or currents at some of the feeding ports. This may allow shortening the time required for gathering all the required information in comparison to the time required when a single detector is used, while reducing price and space in comparison to the price and space required for equipping each feeding port with its own detector.

As used herein, the term processor may include any electric circuit that performs a logic operation on input or inputs. For example, a processor may include one or more integrated circuits, microchips, microcontrollers, microprocessors, all or part of a central processing unit (CPU), graphic processing unit (GPU), digital signal processors (DSP), field-programmed gate array (FPGA) or other circuit suitable for executing instruction or performing logic operations. The instructions executed by the processor may, for example, be pre-loaded into the processor or may be stored in a separate memory unit such as a RAM, a ROM, a hard disk, and optical disk, a magnetic medium, a flash memory, other permanent, fixed, or volatile memory, or any other mechanism capable of storing instructions for the processor. The processor may be customized for a particular use, or can be configured for general-purpose use and can perform different functions by executing different software. If more than one processor is employed, all may be of similar construction, or they may be of different constructions electrically connected or disconnected from each other, they may be separate circuits or integrated in a single circuit. When more than one processor is used, they may be configured to operate independently or collaboratively. They may be coupled electrically, magnetically, optically, acoustically, mechanically, or by other means permitting them to interact.

As mentioned above, other than the microwave power source, the apparatus may include a radiating plate. The radiating plate may comprise, one or more radiating elements and one or more feeding ports. In some embodiments one or each of the one or more radiating elements may be flat in the sense that it has parallel major surfaces greater than any other surface(s) of the radiating element, so the radiating element may be larger in a dimension within the flat area or face than in thickness. For example, in some embodiments, the area of the radiating element may be larger than the square of the thickness by factor of 20, 50, 100, or any intermediate factor. In some embodiments, the radiating element has curves or bumps. For example, a flat radiating element may include slots, bumps, or apertures. Radiating elements with slots and apertures are described, for example, in the context of FIGS. 3A to 3D.

In some embodiments, the radiating plate may also include a conductive base plate that may form a common ground to a radiating element and a feeding port connected to the radiating element. The base plate may therefore act as a ground plate for the radiating element(s) or the radiating plate. The radiating element, specifically its flat face, may be parallel to the conductive base plate. While some deviation from parallelism parallel relationship may be tolerated, designing the radiating plate to provide the required preferential matching is facilitated with the radiating plate parallel to the conductive base plate.

The radiating plate may be configured to provide a match between the microwave power source and the load. In some embodiments, the plate may be strong enough to support the load at or near the center of the plate, when the plate itself is supported only at edges thereof. For example, the plate may be supported on racks, supporting two parallel edges of the plate, and the load may lie on the plate near the plate's center. In some embodiments, the plate may be configured to be capable of supporting a load weighing 1 kg or more in this way, for example loads up to 3 kg, 5 kg, or 10 kg.

The electrically conductive structure may include at least one radiating element, for example, one radiating element or a plurality of radiating elements. One or more of the at least one radiating element may be fed directly by a feeding port. One or more of the at least one radiating element may be connected to a feeding port through a transmission line, e.g. a printed strip of electrically conductive material, a stripline, a microstripline, or a waveguide of suitable aperture. The feeding port itself may be connected to a transmission line transmitting signals from the power source to the port. The connection may be, for example, by an N-type connector. In some embodiments, the central pin of an N-type connector may be welded to the radiating element. Such a welded inner conductor may constitute the feeding port.

In some embodiments, each of the at least one radiating element may be sized to scale with a wavelength of the waves used for heating the load, for example having a perimeter of one wavelength. For example, if patch radiating elements are used, their perimeter may be larger for longer wavelengths. In this context, two wavelengths may be considered: the wavelength a wave has in the load, and the wavelength the wave has in the dielectric layer separating the base plate from the radiating conductive structure.

Generally, the dimensions of an optimal patch antenna with a dielectric layer can be found in the literature for many different shapes and practically for every value of the dielectric layer's dielectric constant. These dimensions may be a starting point for an optimization process aimed at finding the size and shape that would give the best results in heating a load contacting the radiating element at a frequency within a specific frequency range.

As generally known, an electromagnetic wave having a frequency f has a wavelength $$\lambda = \frac{c}{f\sqrt{\varepsilon_r}};$$

wherein c is the speed of light in vacuum, and $\varepsilon_r$ the dielectric constant of the medium in which the wave propagates. Thus, for example, a patch radiating element of a radiating plate of an apparatus configured to heat at a frequency of 915 MHz a load having dielectric constant of 49, may have a perimeter of about 47 mm $$\left(\frac{3\times10^8 m/s}{915\times10^6/s\times\sqrt{49}} = \frac{300\ m/s}{915/s\times7} = 0.047\ \text{m}\right).$$

However, the perimeter may vary depending on the dielectric layer. For example, the larger the dielectric constant of the dielectric layer is the smaller the radiating element may be. Thus, from all the radiating elements designed to match between a source of RF energy at the working frequencies and loads of a given dielectric constant range, the radiating element separated from the conductive base plate by air would be the largest. For example, a patch radiating element designed to heat loads of dielectric constants between 20 and 60 at frequencies between 902 MHz and 928 MHz, where the dielectric layer is air, may have a perimeter of about 350 mm-400 mm, e.g., 380 mm. More generally, the above discussion applies to the largest dimension or effective radiating length of the radiating element where "perimeter" is used above.

The radiating elements may be designed to facilitate good matching in the presence of the load, and poor matching (between the microwave power source and air in the vicinity of the radiating plate) in absence of the load by taking into consideration the dielectric constant of the load to be heated by the apparatus and the dielectric constant of the dielectric layer separating the conductive structure from the conductive base plate. In some embodiments, this preferential matching at the working frequencies in the presence of the load may be achieved even in the absence of a microwave cavity enclosing the radiating plate and the load. Once a perimeter, or more generally the largest dimension or effective radiating length is decided for a radiating element based on the range of frequencies and dielectric constants at which the matching is to be good, a more accurate design of the radiating elements, their location on the radiating plate, and the electrical connections between them and between the feeding ports may be created using simulation tools, and finding (e.g., by educated trials, where simulation results of one structure may be used to try a different structure) a design that provides good matching, at the working frequencies, with a variety of loads. It is noted that some objects may change their dielectric constant during heating. Therefore, the same object, at different temperatures, may be considered a different load. The quality of matching (i.e., "poor" or "good") may be determined based on reflection and transmission coefficients, referred to collectively as S parameters or Γ parameters (gamma parameters). A reflection coefficient is the ratio between the power supplied to a feeding port of the radiating plate from the power source and the power received by the same port at the opposite direction (e.g., from the load). A Γ reflection coefficient may be measured when electromagnetic radiation is supplied simultaneously to two or more of the feeding ports. An S reflection or transmission coefficient is measured when electromagnetic radiation is supplied only to one feeding port at a time. A transmission coefficient is the ratio between the power received at one feeding port and the power supplied to another feeding port. In the present disclosure, S parameters are used, but the matching between the power source and the load may similarly be defined by Γ parameters, dissipation ratios, or any other parameter indicative of the matching. In some embodiments, the matching is considered poor if at least one of the S parameters is larger than −6 dB, that is, if more than 10% of the power supplied to one of the feeding ports returns to the same radiating port or arrives at another feeding port. In some embodiments, the matching is considered good, if each of the S parameters is smaller than 0.05 (or smaller than −3 dB), that is, if less than 5% of the power supplied to a feeding port returns to it, or arrives at other feeding ports. In some embodiments, the matching quality may be defined by terms of a dissipation ratio. A dissipation ratio may be defined as that portion of the microwave power that was supplied to the feeding ports and was not received by any of them, relative to the power supplied to the feeding ports. For example, a dissipation ratio of a single port, e.g., within a multi-port apparatus, may be defined for a port as $DR=1-\Sigma S$, where $\Sigma S$ is the sum of the reflection coefficients of the port and the transmission coefficients from the port to all the other ports. In more explicit notation, the same expression may be written as $DR_i=1-\Sigma_{j=1}^{N}|S_{i,j}|^2$, where N is the number of the ports. A dissipation ratio defined this way is associated with one of the feeding ports (feed i). It is noted that unless otherwise is explicitly mentioned, the term S parameter is used herein to define a ratio of powers, and is the square of the absolute value of the complex S parameter, defined as ratio of voltages. In general, a complex s parameter $S_{i,j}$ is the ratio between a voltage signal measured at feeding port i when only feeding port j radiates. The complex s parameter has a real part, indicative of the ratio between the amplitudes of the signals, and an imaginary part, indicative of the phase difference between the signals. The S parameter (i.e., the square of the absolute values of the complex S parameter), is thus a ratio between the powers of the two signals. In some embodiments, the quality of matching may be defined by an overall dissipation ratio, which defines how much of the power supplied to all the ports together does not return from the load (or from the air, when there is no load on the radiating plate) to any of them. This dissipation ratio may be calculated based on the average of the Γ parameters. A complex Γ parameter $\Gamma_i$ is the ratio between a voltage signal measured at feeding port i when some or all of the ports emit radiation into the cavity. If only one port emits, the gamma parameter is equal to a corresponding s parameter. Unless otherwise is mentioned explicitly, reference to a Γ parameter is a reference to the square of the absolute value of the complex Γ parameter. Thus, a Γ parameter is a ratio between power received in a feeding port and power applied through the feeding port. If the same power is input to each of the ports, then $$DR = 1 - \frac{\sum \Gamma}{N}.$$

If the input powers differ, the average may be weighted by the input powers, and then the overall dissipation ratio may be defined as $$DR = 1 - \frac{\sum P_i \Gamma_i}{\sum P_i}.$$

In some embodiments, the matching quality may be defined by values of the dissipation ratio. For example, good matching may be defined when the dissipation ratio of each of the feeding ports is larger than 0.9, and bad matching may be defined when the dissipation ratio of even one feeding port is smaller than 0.75. Intermediate cases (e.g., when three out of four radiating elements are associated with dissipation ratios larger than 0.9 and the fourth is associated with a dissipation ratio of 0.8) may be defined as intermediate matching. In some embodiments, there may be defined a sharp line between good and poor matching, e.g., a dissipation ratio of each port being higher than 0.85. In some embodiments, the overall dissipation ratio may be used to define matching quality. For example, the matching may be considered poor if the overall dissipation ratio is smaller than 0.75, 0.85, 0.9, 0.95, or any intermediate ratio, and good—otherwise. The invention is not limited to the exact way by which the matching quality is defined. In some embodiments, the matching quality is good even if there is no cavity encompassing the radiating element and the load. This may be evident, for example, if the cavity does not exist at all, or if the cavity has a door, and the door is open.

In some embodiments, when a load having a suitable dielectric constant contacts the radiating plate (e.g., lies on the radiating plate), the matching between the RF power source and the electrically conductive structure is good. This "good matching" may be expressed in that each of the S parameters is smaller than −5 dB (preferably smaller than −10 dB, even better smaller than −20 dB). In a preferred embodiment, the "suitable" dielectric constant is the dielectric constant that a load to be heated by the apparatus is expected to have. For example, if the apparatus is for heating food, the "suitable" dielectric constant is more than 20, for example, between about 20 and about 60. If the dielectric constant of the load is outside the "suitable" range, the matching may be poor.

The exact shape and location of each radiating element may be designed to heat efficiently specific loads, e.g., by simulation. For example, field distributions (e.g., power loss densities, PLDs) and S parameters may be calculated by simulation at various excitation setups (e.g., frequencies, frequency-phase combinations, etc.), for various designs of the radiating plate (e.g., various numbers, sizes, shapes, locations and interconnections of the radiating elements) to find a design that provides good matching with loads having dielectric constants at the predetermined range.

The electrically conductive structure may receive microwave power from the microwave power source through a feeding port. The feeding port may connect the electrically conductive structure to the microwave power source. For example, the feeding port may be an end of a transmission line going from the microwave power source to the electrically conductive structure. In some embodiments, there may be a plurality of feeding ports. In some embodiments, all the feeding ports are fed by the same microwave power source. For example, the power source may include a splitter, and each split of the power may be fed through a different feeding port. In some embodiments, two or more of the feeding ports may be connected to different power sources. In such a case, the sources are synchronized in some embodiments, for example, to control a frequency difference, and/or a phase difference between waves emitted through feeding ports fed by different sources.

In some embodiments, the radiating plate may include, in addition to the electrically conductive structure, a base plate. The base plate may be a ground common to the radiating element and the feeding port. The base plate may be electrically conductive, e.g. metallic, and have a thickness of between about 0.5 mm and about 5 mm, for example, 1 mm, 2 mm, 3 mm or any intermediate thickness. In some embodiments, the electrically conducting structure may be separated from the base plate (e.g. electrically isolated from the base plate) with a dielectric layer. For example, the dielectric layer may be a layer of air, and the electrically conductive structure may be separated from the base plate with spacers. The spacers may be electrically non-conductive, for example, ceramic spacers. The thickness of the air layer may be, in some embodiments, between 2 mm and 10 mm, for example, 5 mm.

In some embodiments, a radiating element may be designed to provide preferential matching based on the wavelengths of the working frequencies in the load. For example, a radiating element may be larger (e.g., may have longer perimeter) as the wavelength inside the load is longer. In some embodiments, the wavelength a wave has in the dielectric layer isolating the electrically conductive structure from the conductive base plate may also be taken into consideration. For example, as the dielectric constant of the dielectric layer is higher, the radiating element may be designed to be smaller in order to provide the requisite preferential matching. Thus, from all the radiating elements designed to match between a source of RF energy at the working frequencies and loads of a given dielectric constant range, the radiating element separated from the conductive base plate with air would be the largest. For example, a patch radiating element designed to heat loads of dielectric constants between 20 and 60 at frequencies between 902 MHz and 928 MHz, where the dielectric layer is air, may have a perimeter of about 350 mm-400 mm, e.g., 380 mm.

In some embodiments, the dielectric layer coats the base plate. For example, in some embodiments, one or both of the base plate faces may be coated with a dielectric layer, e.g., with a solid dielectric layer, while the base plate underneath the coating may be metallic. The base plate may have any thickness larger than the skin depth in the working frequencies. The thickness of the dielectric layer should be at least sufficient to prevent shortcuts between the base plate and the electrically conductive structure. While this minimal thickness may vary according to the dielectric properties of the dielectric layer and the applied power, a ballpark figure for minimal thickness of the dielectric cavity may be 100 micrometers. In principle, there is no upper limit to the thickness of the dielectric layer, as long as heating is not hindered by the dielectric layer. Thicker layers may be advantageous over thinner ones, since thicker dielectric layers may allow working at wider frequency bands. However, thickness may be limited in practice. For example, when coating is used to apply the dielectric layer to the base plate, technological constraints on generating a uniform coating may apply. In some coating technologies, this might pose an upper limit of 400 micrometers, since thicker layers may become non-uniform. Non-uniform coating may show unexpected electrical behavior that might make electromagnetic design of the radiating plate very difficult, or even practically impossible. In some embodiments, the thickness of the dielectric layer may be at least 0.25 mm, preferably 0.4 mm, or thicker.

In some embodiments, the base plate, e.g., the dielectric layer included in the base plate has only a small tendency to absorb microwaves at the frequencies used for heating. This condition may be met, for example, if the dielectric layer separating the base plate from the electrically conductive structure has a loss tangent at the working frequencies smaller than 0.05, or, even better, smaller than 0.01, and even better, smaller than 0.005. The loss tangent of a material (e.g., of the dielectric layer) is a measure of the tendency of the material to absorb RF energy, and may be approximated by the ratio between the real and imaginary part of the relative permittivity of the dielectric layer. Low loss in the dielectric layer of the radiating plate may facilitate transferring the microwave energy into the load. Higher loss may cause larger portions of the applied microwave power to be absorbed by the radiating plate, rather than by the load.

In some embodiments, the electrically conductive structure may be printed on the dielectric layer. In some embodiments, the feeding ports may also be printed on the dielectric layer.

In some embodiments, the radiating plate may include features configured to reduce coupling between different feeding ports. Such features, referred to herein as chokes, may substantially reduce the size of transmission coefficients (e.g., of the non-diagonal elements in an S matrix with entries $S_{ij}$ with i‡j. In some embodiments, the chokes may form part of the electrically conductive structure. feeding port In some embodiments, the chokes may be printed on a dielectric layer coating or otherwise associated with the base plate.

The printing (e.g., of the electrically conductive structure, feeding ports, and/or chokes) may be thick layer printing, for example, as used in printing heating elements. The printing may include heating to temperatures of about 900° C. Processing the radiating plate at temperatures much higher than the temperatures expected to be used for cooking food, may ensure that the resultant radiating plate is food-grade. Since food is usually heated to temperatures not higher than 100° C., and the air in an oven is usually heated to temperatures not above 250° C., radiating plates processed (e.g., during printing) at temperatures much higher than that (e.g., 900° C.), may be food-grade. Food-grade radiating plates may be advantageous for cooking ovens, for example, in light of regulatory aspects. Additionally or alternatively to the electrically conducting structure, the feeding ports may be printed on a dielectric layer of the base plate.

In some embodiments, the apparatus may include a processor configured to improve the matching between the power source and the load or radiating plate in presence of the load (e.g., reduce the S parameters, increase the dissipation ratio, etc.). For example, the processor may select excitation setups (e.g., frequencies, phases, amplitudes, or combinations thereof) at which the matching quality is above a threshold.

For example, the apparatus may include a detector (or several detectors) configured to send to the processor signals indicative of the matching. The detector may be as described above. The signals may be indicative, for example, of power fed through each of the feeding ports at the forward direction (i.e., to the load) and power received in the backward direction at each of the feeding ports. The processor may be configured to send to the microwave power source control signals based on the signals received from the detector. For example, the processor may be configured to receive the signals indicative of powers fed and received, estimate the matching quality based on the received signals, and send to the microwave power source control signals based on the estimated matching quality. For example, the processor may estimate the matching quality at a first excitation setup, and send a signal to the power source to supply power at a second excitation setup. Then, the processor may estimate the matching quality at the second excitation setups, and according to the change in matching quality, select a third excitation setup, and send to the power source a control signal to operate at the third excitation setup. The selection of the third excitation setup may be carried out, for example, using an adaptive heating algorithm. In some embodiments, the matching quality is first determined at a band of excitation setups (e.g., at a frequency band, at a single frequency and a plurality of phase differences, at a band of frequencies and at a plurality of phase differences at each, etc.). Then, excitation setups may be selected based on the matching quality measured at each of the excitation setups in the band. For example, the selected excitation setups may be those, for which a global dissipation ratio is estimated to be larger than a threshold.

In some embodiments, the match-affecting variables controlled by the processor may include the power level supplied to each feeding port. For example, some ports may be supplied no power, while other ports may be supplied with non-zero power levels, which may be the same or different. Accordingly, in some embodiments comprising a plurality of feeding ports, there is also a switching mechanism configured to connect and disconnect at least two of the RF feeding ports from the microwave power source independently of each other. For example, a switching board that is configured to connect or disconnect feeding ports #1 and #2 independently from each other may be configured to connect to the microwave power source only feeding port #1, only feeding port #2, both feeding ports #1 and #2 or none of feedings ports #1 and #2. Such switching mechanism may be controlled by the processor, which may send to the switching board signals indicative to which feeding port is to be connected to the microwave power source, and which is to be disconnected from the microwave power source.

As noted above, even in absence of a microwave cavity, the power source and the radiating plate may be poorly matched when no load is contacting the radiating plate, and well matched when the load is contacting the radiating plate. However, in some embodiments, the apparatus does include an enclosure configured to receive the radiating plate and the object to be heated. In some embodiments, this enclosure does not support standing waves in the working frequencies. For example, the cavity may be made of materials that do not reflect RF e.g., RF absorbers or RF transparent materials. In another example, the cavity may have dimensions that do not support standing waves in the working frequencies. For example, the working frequencies may be below a cut-off frequency of the cavity. In some embodiments, however, the enclosure may function as a microwave cavity. For example, the cavity may support standing waves in the working frequencies. The cavity (e.g., the microwave cavity) may enclose the radiating plate and the load (when the load is present). In some embodiments, the microwave cavity is sized to receive therein the load. The radiating plate may be placed in the cavity, which may be a microwave cavity or other enclosure in such a location, that the load may be received in the cavity when contacting the radiating plate.

Microwave cavities have resonance frequencies. The lowest resonance frequency of an empty microwave cavity (i.e., the lowest frequency that may resonate in the cavity when the cavity is empty) is referred to herein as the cut-off frequency of the cavity. In some embodiments, the microwave cavity enclosing the radiating plate is sized and shaped so that its cut-off frequency is higher than the working frequencies used for heating the load by energy applied to it through the radiating plate. This may ensure that no resonance occurs in the cavity in absence of a load due to the microwave power source connected to the radiating plate.

In some embodiments, the apparatus may include one or more additional heaters, in addition to the microwave heater operating in conjunction with the radiating plate. For example, the apparatus may include a magnetron, to provide conventional microwave heating. In such an embodiment, the microwave cavity may become necessary, and sized so that the cut-off frequency of the empty microwave cavity is lower than the magnetron's frequency. For example, the microwave power source connected to the radiating plate may supply power at frequencies between 902 MHz and 928 MHz, the magnetron may supply power at frequencies between 2400 MHz and 2500 MHz, e.g., at 2450 MHz, and the cut-off frequency of the cavity may be between 928 MHz and 2400 MHz, for example at 1 GHz, 1.5 GHz, or 2 GHz.

In some embodiments, the additional heater may be a general purpose heater, configured to heat a load irrespective of the load's dielectric constant. For example, the general purpose heater may be a convection heater, supplying hot air to the cavity enclosing the load, a conduction heater, e.g., a hot plate, or a radiation heater, e.g., an IR heater. In some embodiments, the electrically conducting structure is printed on one face of the base plate, and a heating element is printed on the other face of the base plate, such that the load is heated by radiation through the electrically conducting structure and by conduction through the heating element.

In some embodiments, the processor may be configured to switch between the additional heater and the microwave power source that operates through the radiating plate. The processor may control the switching so that the additional heater is deactivated when the radiating plate is well matched to the microwave source, and the additional heater is activated when the radiating plate is poorly matched to the microwave source.

Reference will now be made in detail to exemplary embodiments of the invention, examples of which are illustrated in the accompanying drawings. When appropriate, the same reference numbers are used throughout the drawings to refer to the same or like parts.

FIG. 1 is a diagrammatic illustration of an apparatus 100 for heating a load (not shown) with microwave energy. Apparatus 100 includes a radiating plate 102, and microwave power source 110. Radiating plate 102 has four radiating elements 106, and conductive lines or strips 107. Radiating elements and conductive lines connecting them to feeding ports may be collectively referred to herein as an electrically conductive structure. An electrically conductive structure may include additional parts, for example, chokes, as discussed herein. The conducting lines connect the radiating elements to a feeding port 108, the latter being configured to connect the electrically conductive structure to the microwave power source 110. The connection may be, for example, through a transmission line 112 going between feeding port 108 and microwave power source 110. Transmission line 112 may include a waveguide, for example, a coaxial waveguide.

Figure 1A:
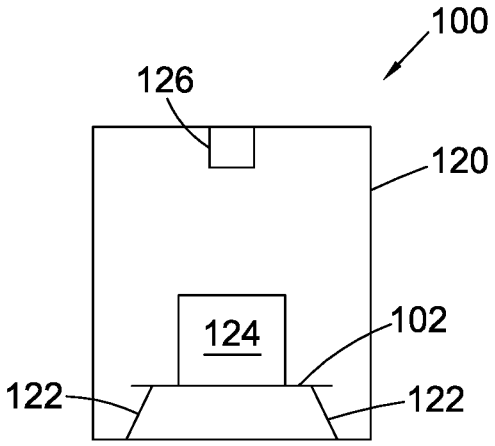
FIG. 1A to 1D are diagrammatic illustrations of embodiments of an apparatus for heating, including an enclosure.

With reference to FIG. 1A, some embodiments of an apparatus 100 for heating a load, which comprises an enclosure 120 around the radiating plate 102 are now described. The radiating plate 102 rests in a tray configuration on supports 122 inside enclosure 120, with the radiating elements 106 facing upwards so as to be able to heat a load 124 disposed in the enclosure 122 to rest on the radiating plate 102. Optionally, the enclosure also houses a secondary heating arrangement 126, for example a convection heater or microwave antenna, as described further herein.

Figure 1B:
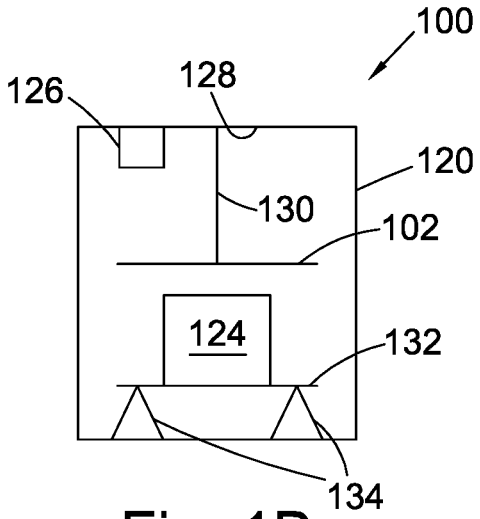

With reference to FIG. 1B, some embodiments of an apparatus 100 for heating a load inside an enclosure 120 are now described. The radiating plate 102 is suspended from the ceiling 128 of the enclosure 120 by a connection member 130, with radiating elements 106 facing a load platform 132 supported inside the enclosure 120 on supports 134. This arrangement enables a load 124 to be disposed on the load platform 132 below the radiating plate 102 for heating from above. The connection member 130 may be adjustable in length (i.e. vertically), either manually or automatically with the aid of a motor, for example, so as to ensure that the radiating plate 102 touches the load 124 for heating. As in the embodiment described above with reference to FIG. 1A, a secondary heating arrangement 126 may be provided.

Figure 1C:
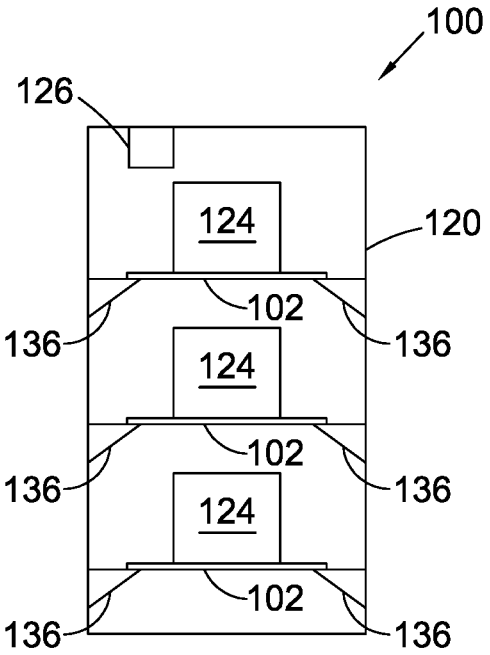

With reference to FIG. 1C, some embodiments of an apparatus 100 for heating multiple loads is now described. The apparatus comprises a plurality of radiating plates 102 supported inside the enclosure 120 on lateral supports 136, with the radiating elements 106 facing upwards. It will be appreciated that, in some embodiments, the radiating plate 102 may be disposed with radiating elements 106 facing downwards, or indeed a combination of upward and downward facing radiating elements may be employed to heat objects 124 from below, from above or from both below and above. In the latter case, radiating plates 102 may be mounted back to back in pairs for each "tray" on supports 136. In any case, a plurality of loads 124 may be heated with this arrangement, disposing a load between each pair of radiating plates 102. It will be noted that unless heating from both sides is required, a load 124 need not necessarily be disposed between pairs of radiating plates to be heated. As above, a secondary heating arrangement 126 may be provided in the enclosure.

Figure 1D:
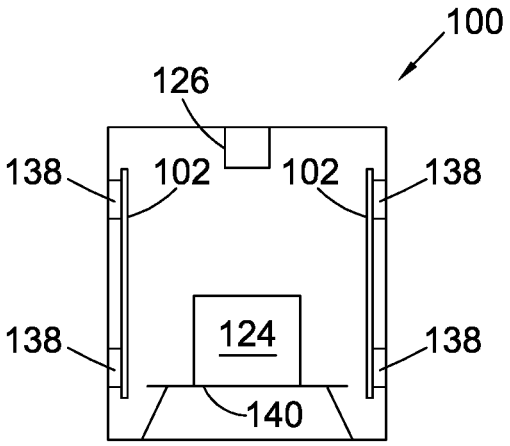

With reference to FIG. 1D, in some embodiments a pair of radiating plates 102 are secured against respective side walls of enclosure 120 by lateral supports 138. A load 124 may be placed on the load support tray 140 between the pair of radiating plates 102 to enable heating of the load 124 from both sides. It will be appreciated that in some embodiments, only a single lateral radiating plate 102 may be employed for heating from only one side, and that the lateral heating embodiment of FIG. 1D may be combined with any one of the embodiments described above with reference to FIGS. 1A to 1C, with an appropriate number of lateral radiating plates 102, as required. Lateral support 138 may be adjustable in length (i.e. horizontally), either manually or automatically with the aid of a motor, for example, so as to ensure that the radiating plate 102 touches the load 124 for heating.

While the embodiments described above with reference to FIGS. 1A to 1D make reference to support elements for supporting the radiating plate 102 inside the enclosure 120, it will be understood that in some embodiments the radiating plate or plates 102 may be incorporated with and form part of the enclosure 120, be that in a tray configuration for heating a load from below, a suspended configuration to heat a load from above or in a side on configuration. The radiating plate 102 may, for example, be part of a bottom, top or side wall of the enclosure 120. In other words, in some embodiments provided, the radiating plate 102 is provided as part of the enclosure in place of being carried or suspended from supports or connection members 122, 130, 136 or 138, as the case may be. Further, it will be understood that the enclosure 120 may be a microwave cavity to enable heating with a free space antenna and appropriate microwave source, as described further herein. In other embodiments, the enclosure merely encloses the radiating plate 102 and the object to be heated 124 from the environment and does not act as a microwave cavity (resonant or otherwise), nor as a waveguide. In any case, the enclosure may be configured so that the space in the enclosure is "seen" by the radiating plate 102 as free space.

It will be appreciated that the drawings in FIGS. 1A to 1D are simplified and omit various constructional details, such as an enclosure door, constructional details of the disclosure walls and surroundings, the arrangement of electronic and power components and connection to the radiating plate or plates 102, the arrangement of radiating element or elements 106 within the radiating plate or plates 102, etc., for the purpose of clarity of presentation.

Figure 2:
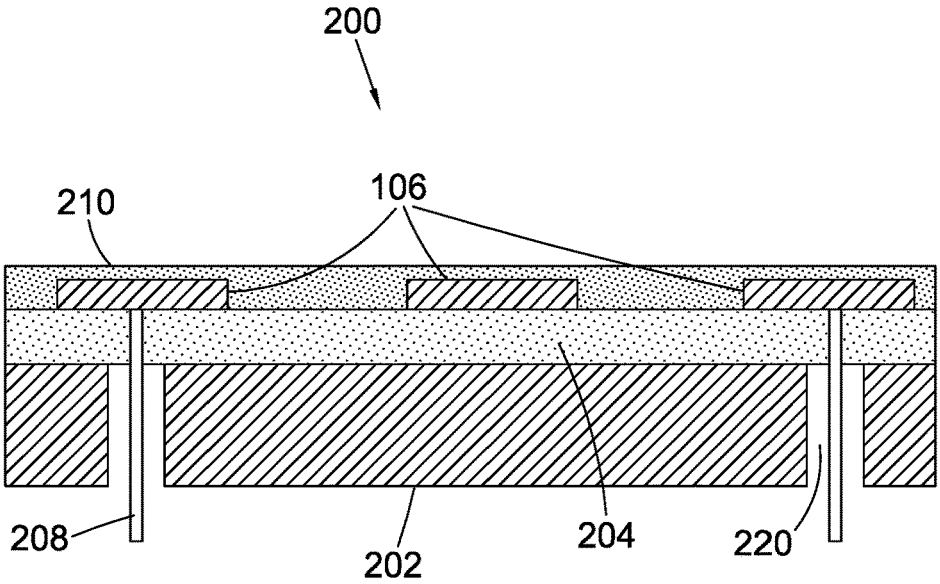
FIG. 2 is a diagrammatic illustration of a radiating plate.

FIG. 2 is a diagrammatic illustration of a radiating plate 200. Radiating plate 200 may include an electrically conductive base plate 202 having an upper face and a lower face. Radiating plate 200 may further include radiating elements 106, electrically isolated from conductive base plate 202, e.g., by a dielectric layer 204 coating the upper face of base plate 202. As explained above, dielectric layers having small loss tangent at the working frequencies (e.g., smaller than 0.05 or even smaller than 0.01) may be preferable. In some embodiments (not illustrated in FIG. 2) the bottom face of base plate 202 may also be coated with a dielectric layer. An electrically conductive structure including radiating elements 106 may be printed on dielectric coating 204, for example, by thick film printing. It is noted that in the embodiments illustrated in FIG. 2 some radiating elements are directly fed from feeding ports 208, without conducting lines such as 107 illustrated in FIG. 1. These radiating elements may, for example, be welded to feeding port 208. Feeding port 208 may be, in some embodiments, an inner conductor of an N-type connector. Additionally, or alternatively, one or more of radiating elements 106 may be fed from a feeding port through conducting lines as illustrated, for example, in FIG. 1.

As described, radiating plate 202 may include one or more (e.g., a plurality of) feeding ports 208. Two feeding ports are shown, but larger or smaller number of feeding ports may be included in various embodiments. The feeding ports may be insulated from base plate 202. For example, feeding ports 208 may go through holes 220 in radiating plate 202. Each of the holes may be wider than the feeding port going through it, so the ports may be isolated from the base plate, for example, by air. In some embodiments, there may be a dielectric material other than air (not shown) filling the holes 220. Radiating plate 200 may further include a second dielectric layer 210. Dielectric layer 210 may cover the electrically conductive structure, for example, radiating elements 106, and may be functional, for example, to protect the electrically conductive structure from scratches. Dielectric layer 210 may be made of the same material as dielectric layer 204, or may be made of different material. In some embodiments, dielectric layer 210 resembles dielectric layer 204 in that it has a loss tangent smaller than 0.05, or, preferably, smaller than 0.01. In some embodiments, second dielectric layer 210 may fill gaps between radiating elements 106 and contact dielectric layer 204. In some embodiments, second dielectric layer 210 may have a flat lower surface that lies on radiating elements 106 but does not penetrate in between them. For example, second dielectric layer 210 may be a glass board, e.g., a 3 mm thick Pyrex™ glass board.

Figure 3A:
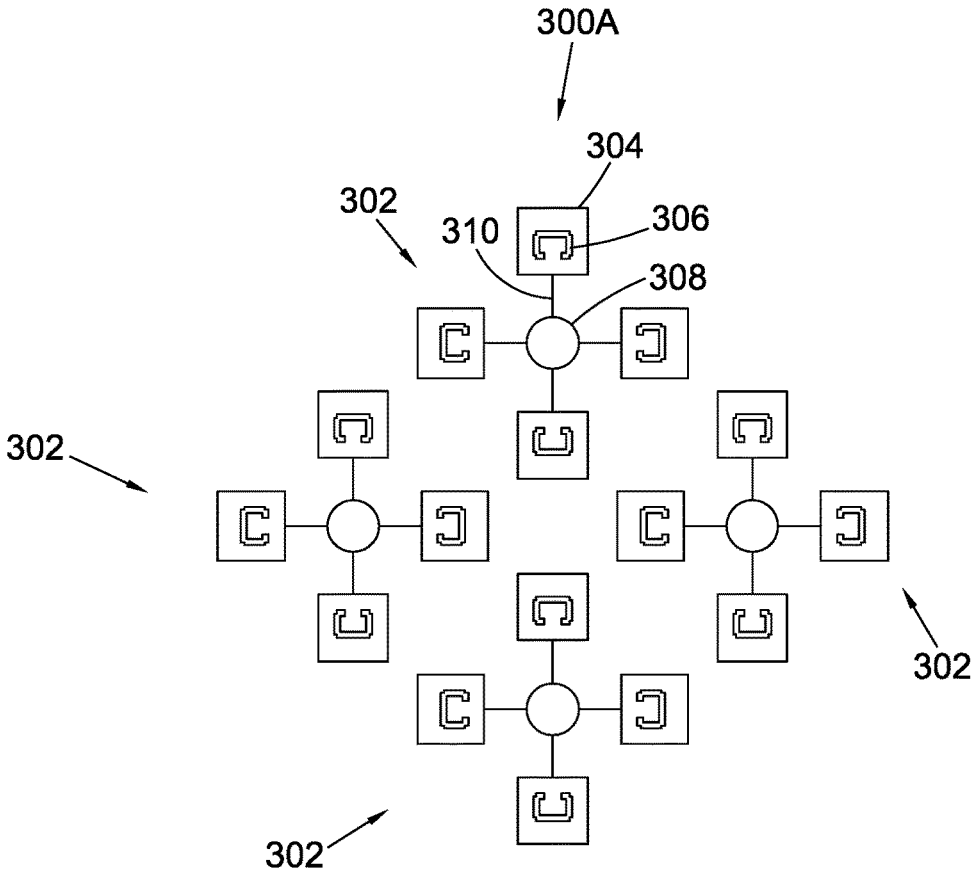
FIGS. 3A, 3B, and 3C, are three diagrammatic illustrations of electrically conducting structures.
Figure 3B:
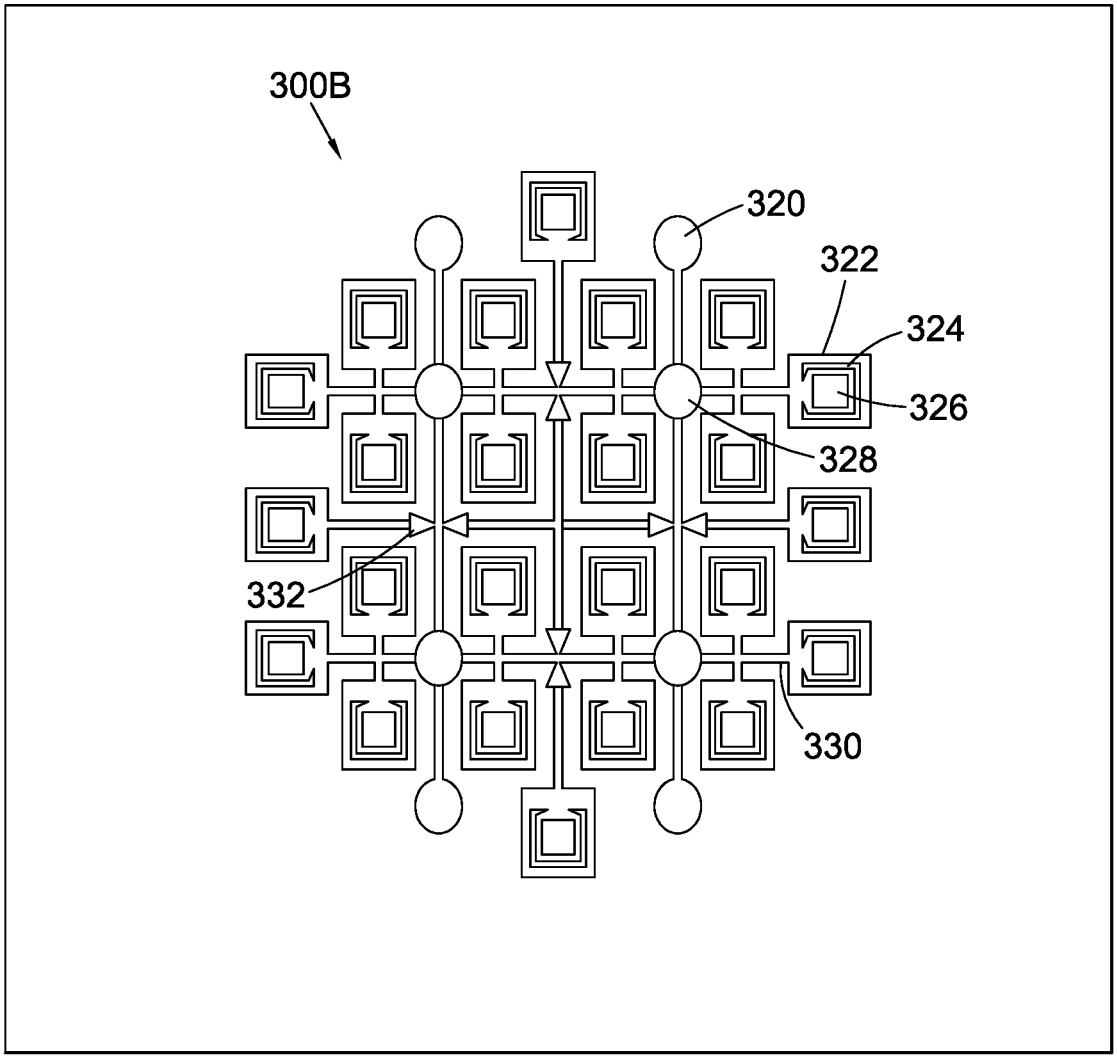
Figure 3C:
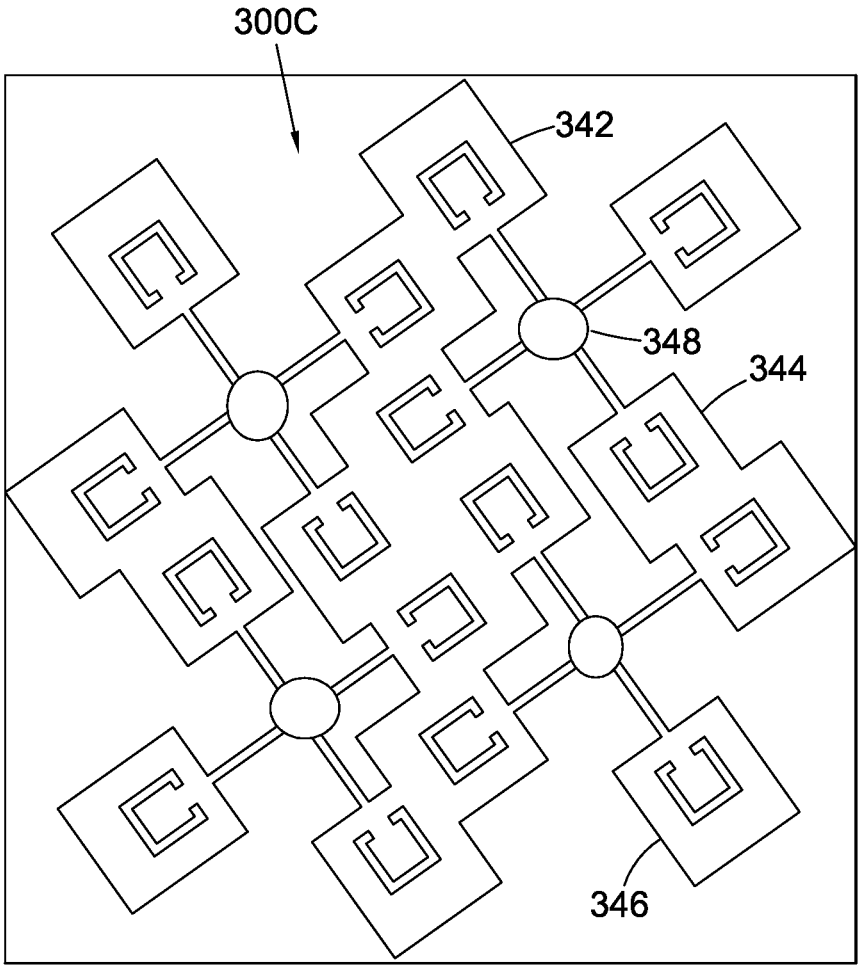

FIG. 3A, FIG. 3B, and FIG. 3C, each illustrates an electrically conducting structure, according to some embodiments.

FIG. 3A is a diagrammatic illustration of an electrically conductive structure 300A. Structure 300A is made of four independent radiating units 302, symmetrically arranged around the center of the structure. Other electrically conductive structures may have radiating units arranged differently, e.g. around a symmetry plane or axis of, e.g., the radiating plate. Each radiating unit 302 includes four radiating elements 304. Each of radiating elements 304 is slotted with an open rectangular slot 306, which can be described as C-shaped, the opening of which is facing the feeding port connected to the radiating element. The exact contour of the slot may be designed to achieve optimal matching to loads with dielectric constants within a given range. In some embodiments, different radiating elements may differ in their shape, size, and/or slotting pattern (for example, some radiating elements may be slotted and some not). In electrically conductive structure 300A, each radiating unit also includes a feeding port 308, connected to each radiating element 304 of the radiating unit through conducting line 310.

FIG. 3B is a diagrammatic illustration of another electrically conductive structure 300B. Structure 300B has radiating elements of two shapes: circular radiating elements 320, and rectangular radiating elements 322. Each rectangular radiating element comprises a slot 324 and an aperture 326. Structure 3B includes four feeding ports 328, each feeding a radiating unit comprising one circular radiating element and a plurality of rectangular radiating elements, connected by conducting lines 330. Electrically conductive structure 300B further includes chokes 332, configured to reduce the coupling between feeding ports connected by conductors with intervening chokes (for example, the two feeding ports at the left hand of the drawing are interconnected through the choke marked as 332). The chokes may be designed to minimize the electrical current going through them from one feeding port to another, based on simulations of the electrical currents going through the electrically conducting structure when the structure is matching between the microwave power source and loads having dielectric constants in the predetermined range.

FIG. 3C is a diagrammatic illustration of yet another electrically conductive structure 300C. Structure 300C has one large radiating element 342, two medium size radiating elements 344, and four small radiating elements 346. Each small radiating element 346 is slotted, similarly to radiating elements 304 of FIG. 3A, and connected at one point to a feeding port 348. Each medium size radiating element 344 comprises two small radiating elements interconnected or partially overlapping with each other. Each medium size radiating element has two connection points, each connecting radiating element 344 to a different feeding port 348. Large radiating element 342 comprises eight small radiating elements interconnected or partially overlapping with each other. Large radiating element 342 has four pairs of connection points, each pair connecting radiating element 344 to a different feeding port 348.

Figure 3D:
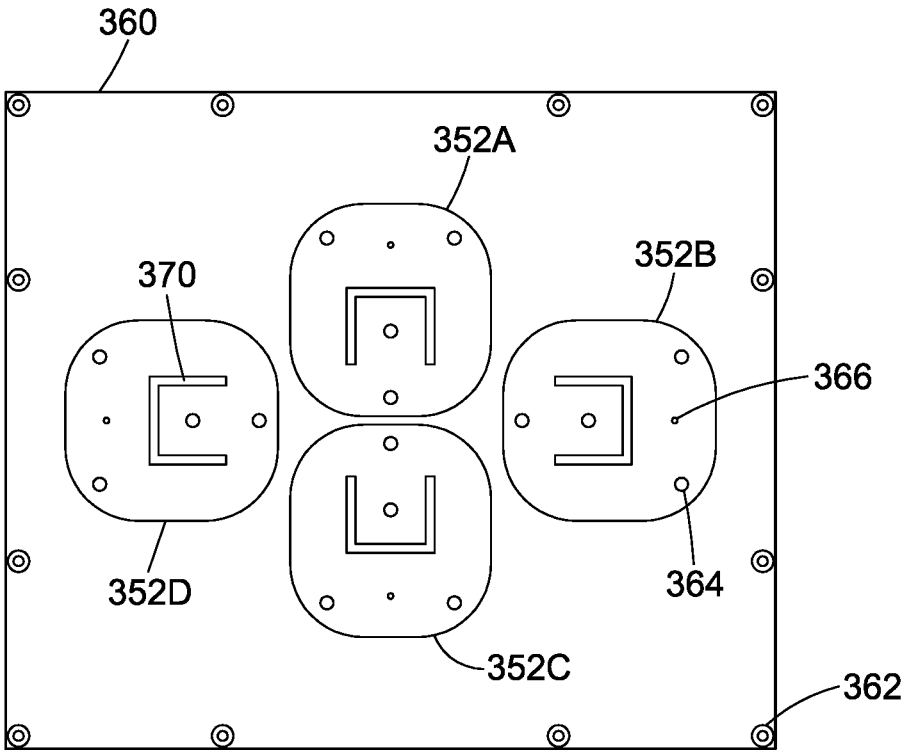
FIG. 3D is a diagrammatic illustration of an electrically conductive structure comprising a plurality of radiating plates.

FIG. 3D is a diagrammatic illustration of an electrically conductive structure comprising a plurality of radiating elements 352A, 352B, 352C, and 352D, collectively referred to as radiating elements 352. In the figure, four radiating elements are illustrated, but any other number, for example, 1, 2, 3, 5, 6, 8, etc. of radiating elements may also compose an electrically conductive structure. The illustrated radiating elements 352A, 352B, 352C, and 352D are not included in a common radiating plate. Rather, they are isolated from each other, and may be considered as four separate radiating plates. Radiating plates 352 have a common conductive base plate 360. Conductive base plate 360 may be attached, for example, to a floor of an oven cavity, by fasteners 362, which may include, for example, screws, bolts, etc. Radiating plates 352 may be spaced apart from conductive base plate 360 by spacers 364. In some embodiments, spacers 364 keep each of radiating plates 352 parallel to conductive base plate 362. In some embodiments, all radiating plates 352 are at the same distance from conductive base plate 362. In the figure, each radiating plate has four spacers 364, but the number of spacers may vary, depending, for example, on the size of the radiating plates, their weight, design, load bearing requirements, etc. In some embodiments, each of radiating plates 352 is connected to a respective source of RF energy (not shown) via a feeding port 366. In some embodiments, the radiating plates 352 are connected to a common source of RF energy via their respective feeding ports 366. The RF sources that feed feeding ports 366 may be independent of each other, or may be centrally controlled. For example, signals generated by a single signal generator may be split, and each split may be delivered to one of the feeding ports. In another example, each source may include a DDS, and the DDSs may be synchronized with each other. Radiating plates 352 may be positioned one in respect of the other so as to minimize or reduce coupling between the different feeding ports. Having radiating elements separated from each other on different plates may obviate the need for chokes, discussed above. In absence of a load, the radiating elements may be electrically independent of each other. However, in the presence of a load contacting two or more of radiating plates 364, the radiating plates contacted by the load may interact with each other. For example, field patterns generated inside the load may be influenced by phase differences between electrical signals delivered to the radiating plates through the respective feeding ports 366. In FIG. 3D, each radiating plate comprises a single radiating element. In some embodiments, each radiating plate may comprise a plurality of radiating elements, for example arranged as discussed above with reference to FIG. 3A-C. In some embodiments, the radiating plates may be covered with a second dielectric layer, as discussed above.

Each radiating plate 352 may include a slot 370. Slot 370 may function as a matching circuit, and may be designed to optimize matching between the radiating plates and loads having dielectric constants in the given range, at the working frequencies, as discussed above.

Figure 4:
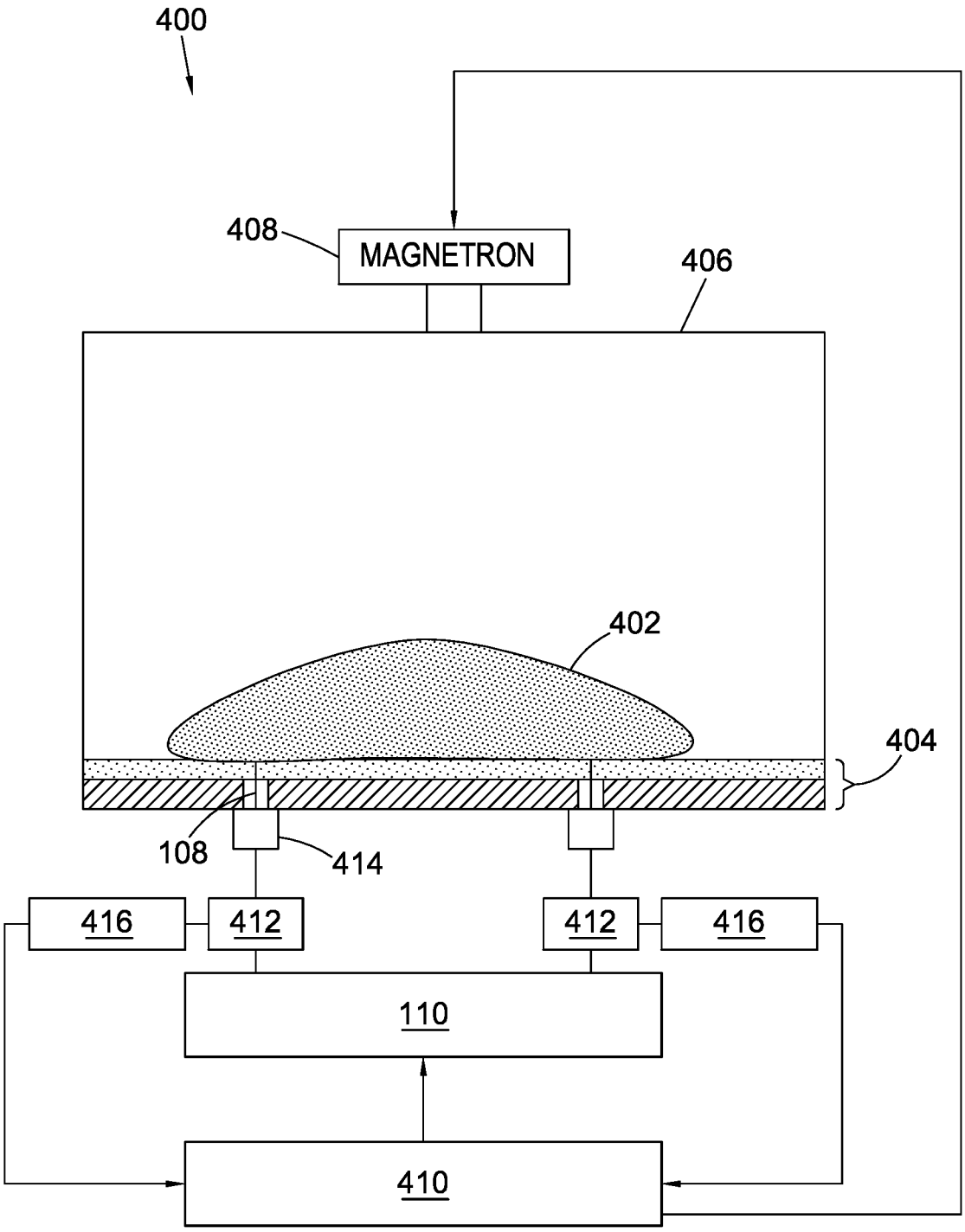
FIG. 4 is a diagrammatic illustration of an apparatus for heating a load with microwave energy.

FIG. 4 is a diagrammatic illustration of an apparatus 400 for heating a load 402 with microwave energy. Apparatus 400 includes radiating plate 404, and microwave power source 110. Radiating plate 404 may be, for example, similar to radiating plate 102 of FIG. 1, or to radiating plate 200 of FIG. 2. For example, radiating plate 404 may include an electrically conductive structure (not shown in FIG. 4, for example configured as shown in and discussed above with reference to FIGS. 1, 2, and 3A to 3D), and a plurality of feeding ports 108. Two feeding ports are shown in the figure, but the invention is not limited to the number of feeding ports, and may operate with 1, 2, 3, 4, 8, 10, 16, 20, 30, 64, or any intermediate number of feeding ports. In some embodiments, even larger number of feeding ports may be included in apparatus 400. Feeding ports 108 may be configured to connect the electrically conductive structure to microwave power source 110. The connection may be, for example, through a transmission line 112 going between feeding port 108 and microwave power source 110. Transmission line 112 may include a waveguide, for example, a coaxial waveguide. In some embodiments, transmission line 112 and feeding port 108 may be connected to each other by a connector 414. The connector may be, for example, an N-type connector. In some embodiments, feeding port 108 may itself be a part of a connector, e.g., the inner conductor of an N-type connector. The ground of the N-type connector may be connected (e.g., by welding) to grounding pate 202.

Apparatus 400 may further include a microwave cavity or other enclosure 406. Cavity 406 and radiating plate 404 may be designed to allow load 402 to contact the radiating plate. For example, the cavity may include a tray near the top of cavity, designed such that when load 402 is on the tray, the load may contact the radiating plate. In some embodiments, radiating plate 404 may form the bottom of microwave cavity 406, may lie on the bottom of the microwave cavity, may be attached to the bottom of the microwave cavity, e.g. by welding, etc., or disposed anywhere else so that a bottom surface of load 402 may contact radiating plate 404. In some embodiments, radiating plate 404 may lie on racks (not shown) inside microwave cavity 406, leaving space between the bottom of the microwave cavity and the radiating plate. Such space may be useful, for example, in apparatuses that also include convection heaters, in which case hot air is to be circulated underneath the object to be heated, i.e. underneath the load. Such racks may also be useful to include several parallel radiating plates within a single microwave cavity. Each of such parallel radiating plates may have its own electrically conductive base plate. Such radiating plates may be fed, for example, through walls of the microwave cavity other than (or in addition to) the bottom, for example, side walls or upper wall of the cavity may include connectors that may be connected to feeding ports. As discussed above, microwave cavity 406 may be dimensioned to resonate only at frequencies higher than the frequencies at which power is supplied to radiating plate 404 by microwave power source 110. In apparatus including an additional microwave heater, e.g., a conventional one, microwave cavity 406 may resonate at the frequencies used for heating by the conventional microwave heater, e.g., 2.45 GHz.

Apparatus 400 may also include magnetron 408 as an additional heater. In some embodiments, apparatus 400 may include a convection heater (not shown) as an additional heater, instead of, or in addition to magnetron 408. Magnetron 408 may heat the load by radiating into microwave cavity 406 microwave radiation at magnetron frequencies, that may be above the lowest resonance frequency of the microwave cavity when the microwave cavity is empty. A cavity may be considered empty if the object to be heated is not inside the cavity. Apparatus 400 may also include a mode stirrer (not shown), for example, in the form of a rotating conductive fan, configured to stir the modes excited in cavity 406 by magnetron 408 to improve the uniformity of heating provided by the magnetron. Apparatus 400 may further include a processor 410, configured to control microwave power source 110, and magnetron 408. In embodiments including further heaters, processor 410 may be configured to control them also. In some embodiments, processor 410 may be configured to activate the magnetron mainly, or, in some embodiments, only, when the dielectric constant of the load is outside the predetermined range, for example, when microwave power source 110 is poorly matched to the load, as may be evident, for example, by S parameters larger than 0.1. For example, when a frozen foodstuff (e.g., a frozen pizza) is to be heated by apparatus 400, the frozen foodstuff may have dielectric constant outside the predetermined range (e.g., lower than 20). As a result, the matching between microwave power source 110 and load 402 may be poor, and reflections back towards the microwave power source may be strong (e.g., more than 10% of the power supplied to each radiating element may return). Under such conditions, processor 410 may control heating the frozen foodstuff by the magnetron and/or by any other available conventional heater (e.g., a convection heater), but not by microwave power source 110. While there is no necessity to ensure no overlap between heating by microwave power source 100 and by the other heaters when the matching is poor, such overlap may exist, for example, during 1%, 10%, 20%, or smaller or intermediate portions of the time of poor matching. Accordingly, during the poor matching, heating is mainly by one or more of the additional heaters. When the matching improves, heating may be carried out by microwave power source 110, and heating by one or more of the additional heaters may continue or stop. Heating by the magnetron, for example, may be quicker and less controlled (e.g., less even) than heating by microwave power source 110. Thus, operation of the magnetron when the matching is good may result in quicker, but less controlled heating. Convection heating may contribute to browning of the food stuff (e.g., if the load includes a bread loaf to be cooked). Thus, in some embodiments, processor 410 may control convection heating and dielectric heating by microwave power source 110 to take place at the same time when the matching is good.

In some embodiments, processor 410 may be configured to select excitation setups for heating the load. For this (or other) end, processor 410 may receive feedback indicative of the matching between the load and microwave power source 110. For example, a coupler 412 may sample microwave signals going from feed 108 back towards microwave power source 110, and couple them into a detector 416. Additionally or alternatively, coupler 412 may be configured to sample microwave signals going the other way around (i.e., from microwave power source 110 to feeding port 108), and couple them into the same or other detector. The processor may be configured to receive from the detectors detection results (e.g., power going through the feed in each direction, ratio between the powers going in the two directions, phase differences between the signals going in the two directions, etc.), and use them to calculate a value indicative of the quality of matching between load 402 and microwave power source 110, as discussed above. Processor 410 may be equipped with suitable software or hardware to select, based on the calculated values, excitation setups for heating. For example, processor 410 may be configured first to control microwave power source 110 to supply power at a plurality of excitation setups. Upon receiving the feedback to the microwave power supply at each of the excitation setups, processor 410 may calculate the quality of matching at each, and select for heating the excitation setups for which the highest matching was calculated. Then, processor 410 may send microwave power source 110 control signals to supply power at the selected excitation setups. In some embodiments, the processor may be configured to send the control signals so that only the selected excitation setups are used for the heating.

Figure 5:
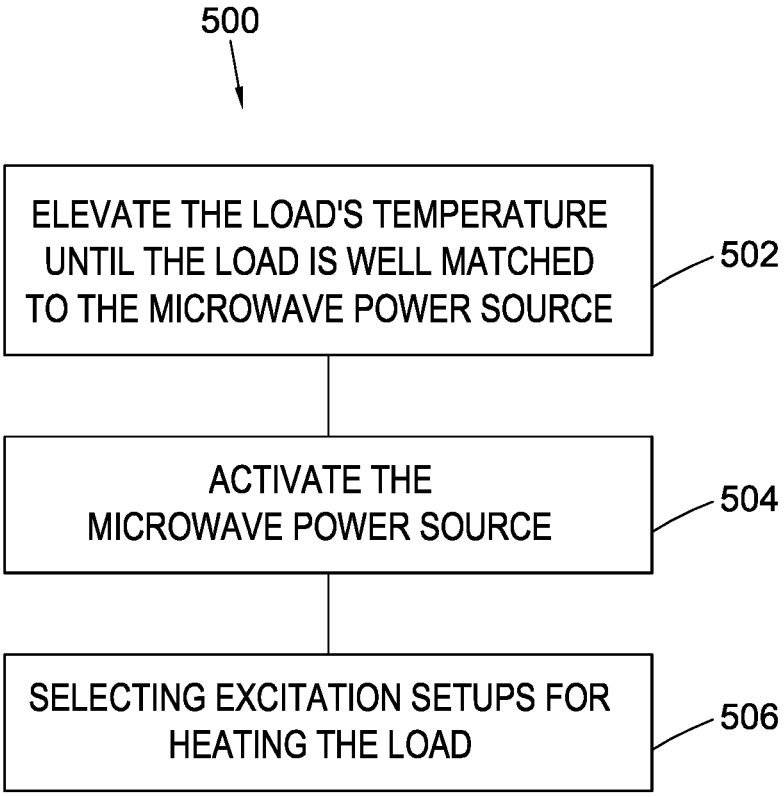
FIG. 5 is a flowchart of a method of cooking a food item.

FIG. 5 is a flowchart of a method 500 of cooking a food item, or, more generally, of heating a load that may change its dielectric constant during heating. The heating (e.g., the cooking) may be by an apparatus comprising a microwave power source, for example power source 110; a radiating plate, for example radiating plate 102, 200, 300A-D; and a feeding port, for example feeding port 108, 208, etc., connecting the radiating plate to a microwave power source, for example power source 110. More generally, the method may be performed with an apparatus as described above in various embodiments. The apparatus may be adapted to heat most efficiently loads having dielectric constants within a predetermined range. The method may be utilized with loads that change their dielectric constant during heating, one or more times, from values outside the predetermined range to values within the predetermined range, or vice versa. For example, the load may include a food item that has a dielectric constant smaller than 20 at temperature of −18° C., and above 20 at temperatures higher than −5° C., for example, a frozen pizza. If the apparatus in this example may heat efficiently only loads with dielectric constants between 20 and 60, during defrosting, the pizza's dielectric constant will change from being outside the range to being within the range.

Method 500 may include a step 502 of elevating the temperature of the food item to be cooked, or, more generally, of the object to be heated. This may be carried out outside the apparatus, e.g., by a separate heater, or by letting the temperature of the frozen food item to equilibrate towards the room temperature, or in any other way. In some embodiments, step 502 is carried out by an additional heater that may be included in the apparatus. Step 502 may continue up to the point where the dielectric constant of the food item is within the predetermined range, which may be the same as the point at which the microwave power source is well matched to the food item. This point may be identified, for example, by measuring the temperature of the food item (e.g., if a relationship between the temperature and the dielectric constant is known in advance), by measuring the time the food item raises in temperature outside the apparatus (e.g., if a correlation between this time and the matching is known in advance), or by measuring the matching or parameters indicative thereof periodically, for example, every 10 second, every 30 seconds, every minute, every 5 minutes, etc. In some embodiments, matching measurements may take place inside the apparatus. The periodicity of matching measurements may be set in advance, or adjusted, for example, to be more frequent as the matching improvement is more rapid.

Method 500 may further include step 504 of activating the microwave power source associated with the radiating plate(s) to heat the food item. This step may be taken when the microwave power source is well matched to the food item. Heating by other means than the microwave power source connected to the electrically conductive structure may be stopped, or continued, for example, if the other means are configured to heat the load when the load lies on, or otherwise contacts, the radiating plate.

During heating using the microwave power source connected to the radiating plate, the excitation setup used for heating may be adjusted based on feedback from the load, indicative of the matching between the load and the microwave power source at various excitation setups. For example, the matching may be evaluated at a plurality of excitation setups (e.g., at a plurality of frequencies, phase difference, amplitude ratios, or combinations thereof), and based on this evaluation, excitation setups may be selected. For example, in some embodiments, a predetermined number of the excitation setups, for which the best matching was evaluated, may be selected. In some embodiments, excitation setups evaluated to provide matching above some threshold (e.g., DR larger than 0.8) may be selected. The method may further include heating the load preferentially with the selected excitation setups. For example, in some embodiments, only selected excitation setups may be used for heating. In some embodiments, non-selected excitation setups may be used for heating only for a short period, and/or at lower power levels, while selected excitation setups may be used for longer periods and/or at higher power levels. Thus, method 500 may include a step 506 of selecting excitation setups for heating the load based on feedback indicative of the matching between the microwave power source and the frozen food item, and controlling the source to heat the load at the selected excitation setups.

Figure 6:
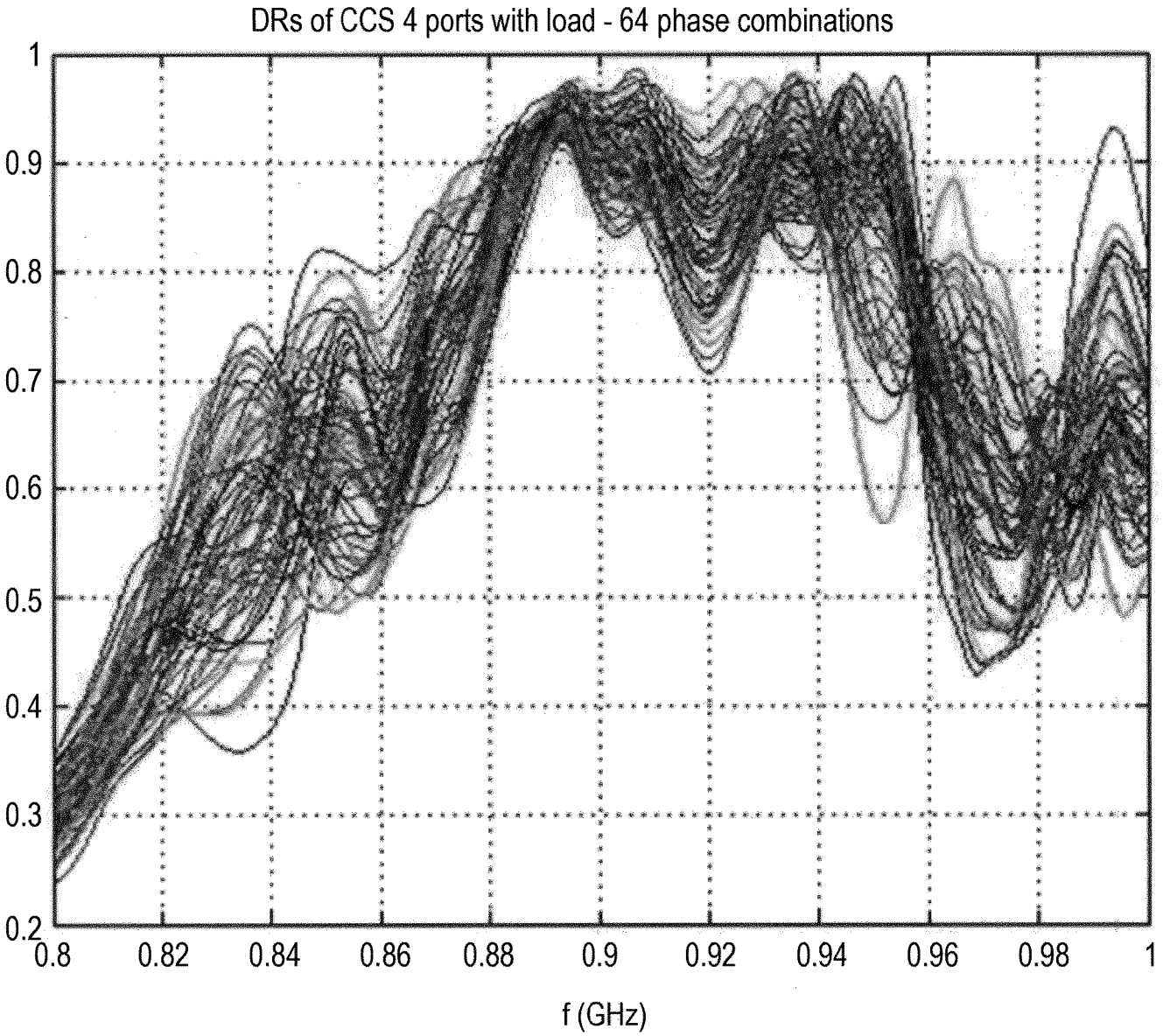
FIG. 6 is a graph illustrating contact efficiency in an example of a radiation plate.

FIG. 6 is a graph showing contact efficiency values (also referred to herein as dissipation ratio values or DR values) calculated from a simulation of a load on a radiating plate according to an embodiment of the invention. The radiating plate was similar to that illustrated in FIG. 3A, having four radiating ports, each connected to four radiating elements. The load was a multicomponent dish that included vegetables, salmon, and beef. The various components had dielectric constants in the range of 40 to 67 and loss tangents in the range of 0.2 to 0.4 at 915 MHz. The radiating plate was optimized for the range of working frequencies between 902 MHz and 928 MHz. Each line in the figure shows the contact efficiency values calculated for a certain set of phase differences between signals supplied to the differing radiating ports. As the radiating plate had four radiating ports, and phase steps were of 90° there are three independent phase differences for each port, and the number of phase combinations available is $4^3=64$. As can be seen in the figure, at all phase combinations, the contact efficiency value is higher than 0.5 at least in the frequency range of 860 MHz and 960 MHz, and higher than 0.7 at the range of 902 MHz to 928 MHz. The contact efficiency values were calculated from simulated s parameter values according to the equation $$DR = 1 - \frac{\sum_{i=1}^{n} \left| \sum_{k=1}^{n} S_{ik} a_k e^{j\varphi_k} \right|^2}{\sum_{k=1}^{n} a_k^2}$$

explained in more detail in WIPO patent application publication no. WO2014/006510, herewith incorporated by reference.

Figure 7:
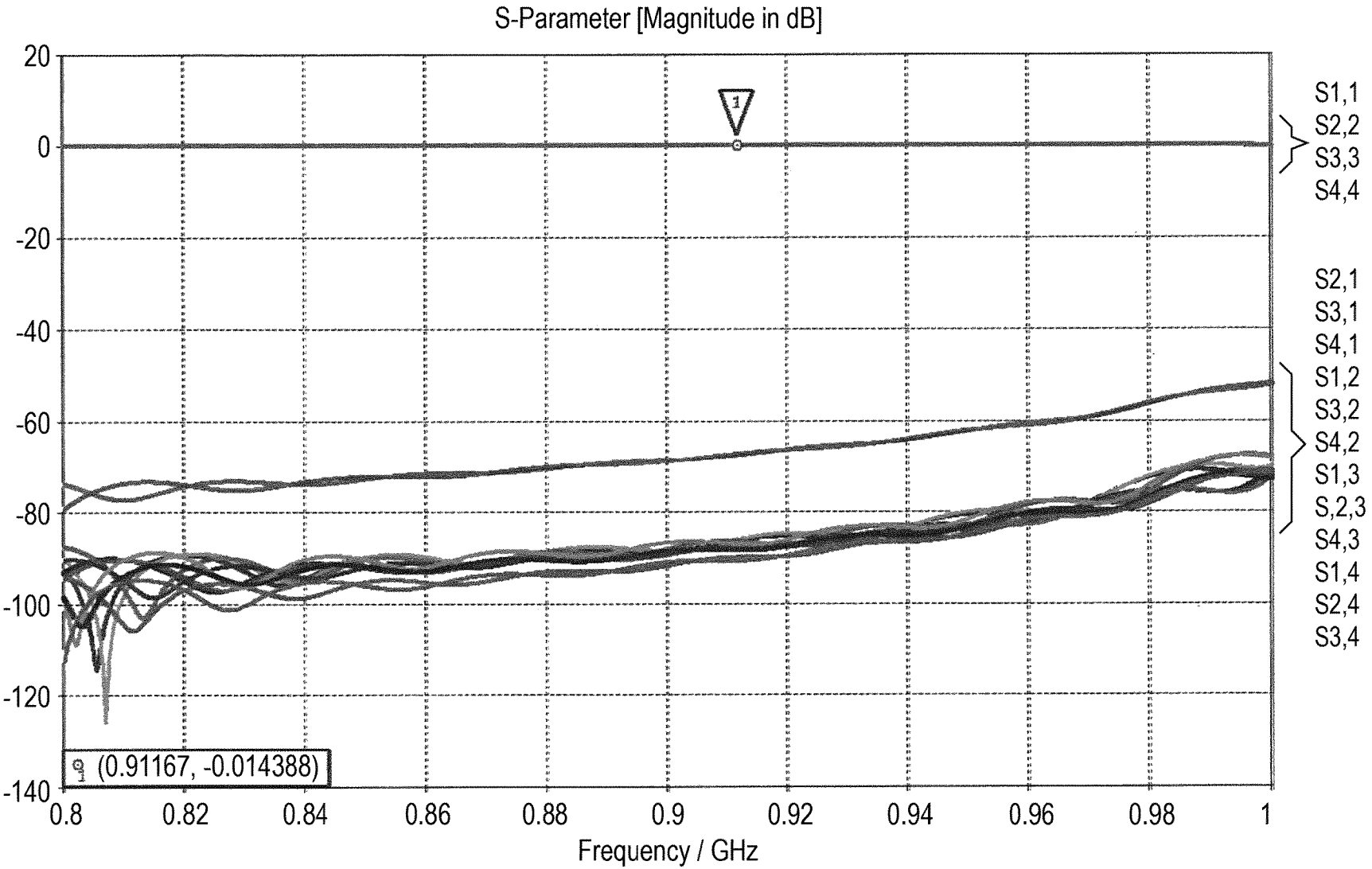
FIG. 7 is a graph illustrating S-parameters for the example radiation plate.

FIG. 7 is a graph showing S parameter values calculated for a radiating plate similar to that of FIG. 3A, in absence of any load in its vicinity, that is, under free space conditions. As shown in the figure, the diagonal s parameters are all equal to 1 at the entire frequency range of 0.8 GHz to 1 GHz (0 dB, in the logarithmic scale shown). This shows that all the power supplied to each radiating port returned back to the same radiating port. The values of the non-diagonal phase parameters were all in the range of −55 dB to −130 dB, which shows that practically no power was coupled from one port to another. Calculating DR by the above equation, for any phase combination and amplitude ratio results in DR that is extremely near to 0, and in all cases less than −6, −8, −10, or −20 dB.

Figure 8A:
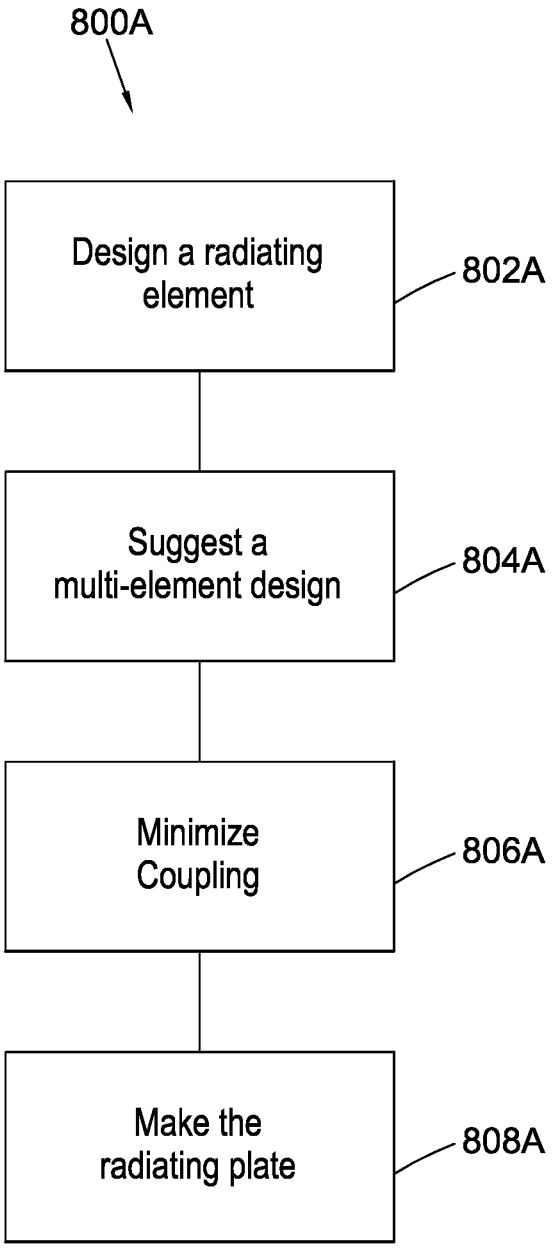
FIGS. 8A to 8C are flow charts illustrating methods of designing and making radiation plates.

FIG. 8A is a flowchart of a method 800A of making a radiating plate according to some embodiments of the invention. Method 800A includes a step 802A of designing a single radiating element, a step 804A of suggesting a multi-radiating element design for the radiating plate, and a step 806A of minimizing coupling between the radiating elements. Step 806A may also include fine tuning of the shape or size of one or all of the radiating elements. At step 808A, a radiating plate is made in accordance with the design.

Figure 8B:
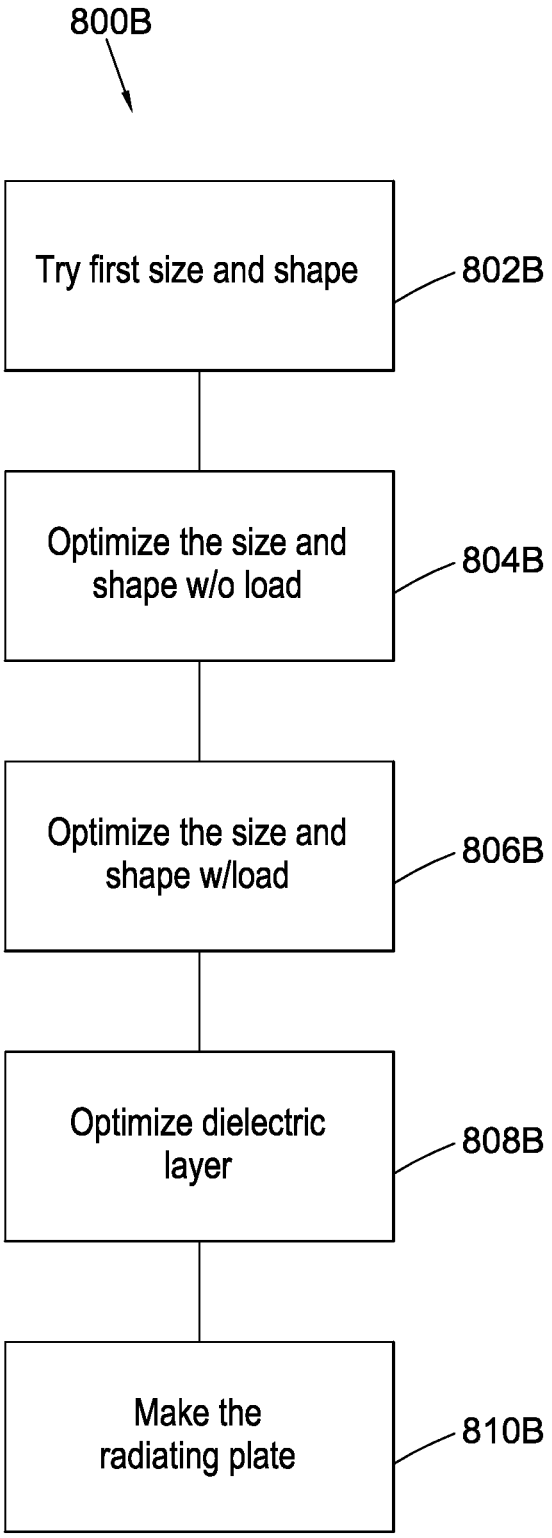

A flow chart of a method 800B for designing a single radiating element according to some embodiments of the invention is shown in FIG. 8B.

In step 802B, a first size and first shape of the radiating element are tried. The first size and shape may be suggested based on antenna design principles for designing an antenna to radiate into free space at much higher frequencies than the working frequencies, or in any other way that the designer finds suitable. Similarly, the design may be made for wavelength in a different medium, for example, non-free space medium corresponding to a typical permittivity of the range of loads for which the design is made. For example, the radiating element may be designed so as to resonate at this other medium. For example, if the designer looks for radiating elements for heating loads having dielectric constant of about 50 at frequencies around 1 GHz, the designer may design an antenna for radiating into free space at 7 GHz. This way, small radiation efficiency at 1 GHz may be expected, while a higher total radiation efficiency may be expected at 1 GHz in a medium having a higher dielectric constant. Obtaining or refining further desired electromagnetic characteristics may be achieved by further optimization.

In step 804B, the size and shape may be optimized in absence of a load. For example, a simulation may be run with the radiating element suggested in step 802B, and field patterns developed on it and away of it at the working frequencies may be studied. In some embodiments, the simulation may be run on a radiating element covered with a protective dielectric layer (cover dielectric layer). Typically a dielectric cover layer with a small loss tangent, comparable to that of the dielectric insulating layer and of a thickness of 10 to 30 μm is used. Typically the dielectric layer is included in the simulations but not optimised itself. Studying the fields obtained at a frequency range broader than the working frequency range may also be useful. For example, if the target field characteristics are obtained outside the working frequency range, but near it, this may provide a clue as to how the radiating element is to be changed in order to obtain the target field characteristics with frequencies within the working frequency range.

One target of the optimization process may be to obtain a plurality of field intensity peaks at the surface of the radiating element. Another optimization target may be to minimise total radiation efficiency of the radiating element at the working frequencies. Another optimization target may be to maximize return loss, that is maximising the diagonal entries in the S-parameter matrix.

Optimizing the size may include changing the overall size of the radiating element to get closer to the target. Optimizing the shape may include changing the aspect ratio of the radiating element, rounding corners in the radiating element, adding slots or other structures (e.g., bumps) to the radiating elements, changing a shape, position, and/or orientation of a slot or other structure in the radiating elements, changing the position of the feeding point. The distance to the optimisation target may be estimated based on a simulation carried out with the changed radiating element, and comparing the simulation results to those obtained with the radiating element before the change.

The process of suggesting a design, simulating field characteristics, and changing the design to come with a new suggestion may be repeated as many times as required until the optimisation targets are satisfactorily achieved or approached.

In step 806B the size and shape of the radiating element may be optimized in presence of the load, for example, with a load belonging to the range of loads contacting the radiating element. The optimization may include simulation of the electromagnetic response of a system comprising the radiating element and the load to electromagnetic signals in the working frequency range, studying the fields, currents, efficiencies, and other electromagnetic characteristics of the system that may be obtained by the simulation, and changing the size and/or shape of the radiating element to get closer to the optimization targets. Simulating, studying, and changing, may be repeated as required to get as close as desired to the optimisation targets.

The targets of this optimization step may include generating high intensity electrical fields in various portions of the load, increasing the number of electric field distributions obtainable in the load within the range of working frequencies, increasing the contact efficiency of the radiating element over the range of working frequencies, increasing energy absorption in the load or in a desired portion of the load, decreasing the fields generated outside the load, and increasing the number of resonance frequencies, among the working frequencies, of a system comprising the radiating plate and the load.

It is noted that some radiating plates may be made to work with complex loads, for example, food placed on a glass plate. In such cases, it may be important to ensure that the energy is absorbed by the food, and not by the plate. This may also be a target of the optimization.

The change of size and shape of the radiating element may be similar to the changes available in step 804B, described above. It is noted, however, that the load is not to be changed during the optimization, but only the radiating element contacting it. However, it will be appreciated that step 806B may be repeated for different loads within the range to approach or achieve the optimization targets across the range of loads.

In some embodiments, after a radiating element is optimized to work satisfactorily with the load, it may again be checked to ensure that its free space properties, e.g., its low total radiation efficiency, were not lost. If it did, further optimization without a load may be required, and then, another optimization with the load, until the radiating element functions satisfactorily both under free space conditions and in contact with the load.

In step 808B the dielectric layer between the radiating element and base plate may be optimized. This step may be carried out without a load, with a load, or both with and without a load, for example, before step 804B, between steps 804B and 806B, and/or after step 806B. The dielectric layer may be optimized in relation to its thickness, and in some cases, also in respect of the dielectric constant of the dielectric layer. For example, when the dielectric layer is air, only its thickness may be optimized. When, for example, a solid dielectric layer is used, the dielectric constant may also be manipulated to optimize the performance of the radiating element. The optimization may be, in some embodiments, restricted based on availability of dielectric materials of given dielectric constants and at given thicknesses.

At step 810B, if the desired design involves only a single radiating element (for example, a single element spans the desired heating area), a radiating plate is made according to the design. Alternatively, the design resulting from step 806B or 808B may be used as input to step 804A described above.

Figure 8C:
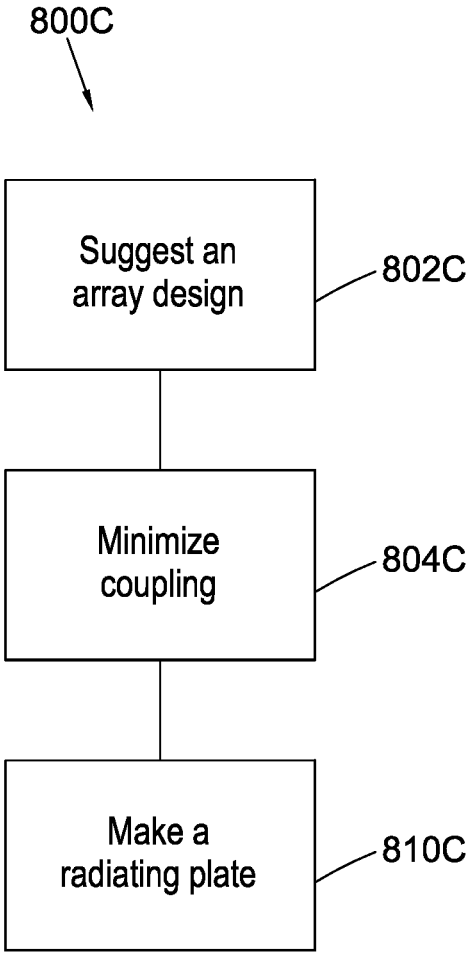

FIG. 8C is a flowchart of a method 800C of minimizing coupling between optimized radiating elements (see step 806A above). Method 800C may be used, for example, if the optimized radiating element is found too small to heat the entire load. In such a case, additional radiating elements may be included in the radiating plate. In some embodiments, the radiating plate may include a plurality of radiating elements, all having the same size and shape, for example, the size and shape obtained by method 800B. In some embodiments, radiating elements of differing sizes and/or shapes may be used in a single radiating plate. Each of the radiating elements in the initial design may be optimized by method 800B, for example, from different starting points. It is noted that in a radiating plate comprising a plurality of radiating elements, some power may be transferred from one radiating element to another. It is preferred, however, that all the power is transferred to the load for heating, therefore, decoupling between the radiating elements may be beneficial.

In step 802C, a first array of radiating elements is suggested. This initial suggestion may be made based on geometric consideration that allow covering a load of a given area and shape with a given number of radiating elements, each being fed independently of the others. The number of radiating elements may be limited, for example, by the number of source available, or by other considerations that may dictate the number of radiating ports that may be fed independently of each other. Of course, all or some of the radiating elements may be fed by the same source. The initial design may include radiating elements of different shapes and sizes, and each of them may go optimization as discussed above before being incorporated into the radiating plate with the other radiating elements.

The first design may be characterized by the position of the radiating elements relative to each other, and in their orientation with respect to the other radiating elements.

In step 804C, the coupling between the radiating elements in the array may be minimized. In some embodiments, minimization may take place in two stages: first, the coupling between the radiating elements is minimized in absence of a load, and then the load is added to improve decoupling in the presence of the load. In some embodiments, however, the coupling between the radiating elements is minimized only in the presence of the load. For example, a simulation may be run with the array of radiating elements suggested in step 802C, and field patterns developed in the load and away of it at the working frequencies may be studied. In some embodiments, the simulation may be run on an array of radiating elements, each having its own ground plate and covered with its own protective dielectric cover layer, or having a common ground plate and protective dielectric layer. As explained in the context of optimizing shape and size of the single radiating element, studying the fields obtained at a frequency range broader than the working frequency range may be useful.

Targets of the optimization may include: maximizing the contact efficiency, and minimizing each of the off-diagonal s parameters, while retaining high heating quality (e.g., heating efficiency, heating uniformity, etc.)

Optimizing the array may include changing the position of each radiating element, e.g., so as to change distances between adjacent radiating elements. Additionally, or alternatively, optimizing the array may include changing the orientation of each of the radiating elements, e.g., so as to change relative orientation between them. In some embodiments, in which radiating elements in the array are electrically connected to each other, further elements may be added and/or changed during the optimization process. For example, the width of electrical connections between radiating elements may be optimized to reduce coupling, and field barriers or chokes may be designed to be placed between radiating elements to decouple the radiating elements from each other.

In some embodiments, optimizing the array may include changing the size, and/or shape, of one or more radiating elements to reduce coupling. Also, coupling may be reduced by changing slots, or any other structuring element with which the radiating element is designed.

The process of suggesting a design, simulating currents to identify coupling and/or fields to calculate contact efficiency, and changing the design to come with a new suggestion may be repeated as many times as required until the optimisation targets are satisfactorily achieved or approached.

At step 810C, a radiating plate is made according to the design. In some embodiments, after a radiating plate is designed and made as described above, the radiating plate may be made and tested in a heating apparatus. In these tests, test loads may be heated, and heating results recorded to see if the results in the heating apparatus are indeed as satisfactory as could have been expected based on the simulations. The test loads may include, for example, glasses of water, food dishes such as dough, meat, fish, vegetables, or any other kind of load. The target in this stage may be defined in terms of speed and uniformity of cooking various dishes.

In the foregoing Description of Exemplary Embodiments, various features are grouped together in a single embodiment for purposes of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate embodiment of the invention.

As used herein, the singular form "a", "an" and "the" include plural references unless the context clearly dictates otherwise. The use of the terms "at least one", "one or more", or the like in some places is not to be construed as an indication to the reference to singular only in other places where singular form is used. For example, throughout this specification, references are made to "object", "an object", or "the object" in singular. This term is used to refer to one or more objects, to an object comprising a plurality of objects, to a portion of an object, or the like.

The terms "comprises", "comprising", "includes", "including", "having" and their conjugates mean "including but not limited to". This term encompasses the terms "consisting of" and "consisting essentially of". The phrase "consisting essentially of" means that additional components may exist, but only if the additional components do not materially alter the basic characteristics of the claimed subject matter. The term "consisting of" means "including, and limited to".

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims It will be apparent to those skilled in the art from consideration of the specification and practice of the present disclosure that various modifications and variations can be made to the disclosed systems and methods without departing from the scope of the invention, as claimed. For example, one or more steps of a method and/or one or more components of an apparatus or a device may be omitted, changed, or substituted without departing from the scope of the invention. Thus, it is intended that the specification and examples be considered as exemplary only, with a true scope of the present disclosure being indicated by the following claims and their equivalents.

The invention claimed is:

1. A heating apparatus for heating an object, the apparatus comprising an enclosure for accepting the object adjacent to a radiating plate for heating and a microwave power source coupled to the radiating plate and configured to feed the radiating plate at one or more microwave frequencies, wherein:

the radiating plate is an object heating radiating plate configured to heat the object with feed signals having a range of microwave working frequencies of between 300 MHz and 3 GHz, and the radiating plate comprises:

a ground plate; and at least one or more radiating elements spaced from the ground plate by a dielectric layer, wherein at least a size and a shape of the one or more radiating elements and at least a thickness of the dielectric layer satisfy the following conditions:

a free space efficiency of the radiating plate is less than −6 dB and a contact efficiency of the radiating plate is greater than 50%, the free space efficiency is a ratio of power not returned from the radiating plate to power fed to the radiating plate at a test frequency in the range of working frequencies in a free space condition in which there is a volume of free space covering the radiating plate, the contact efficiency is a ratio of power not returned from the radiating plate when a test load rests on top of the radiating plate to power fed to the radiating plate at the test frequency, and the test load has a dielectric constant in the range of 20 to 60 and a loss tangent in the range of 0.1 to 0.5 at the test frequency, wherein said conditions are configured to provide a first amount of energy transfer from the radiating plate to the test load with the radiating plate being in contact with the test load while providing a second amount of energy transfer, smaller than the first amount, with the radiating plate not being in contact with the test load.

2. The heating apparatus according to claim 1, wherein the free space efficiency of the radiating plate is less than −6 dB and the contact efficiency of the radiating plate is greater than 0.5 for test loads having respective dielectric constants of 20, 40 and 60.

3. The heating apparatus according to claim 1, wherein the free space efficiency of the radiating plate is less than −6 dB and the contact efficiency of the radiating plate is greater than 0.5 for test loads having respective loss tangents of 0.1, 0.3 and 0.5.

4. The heating apparatus according to claim 1, wherein the dielectric layer comprises an air layer.

5. The heating apparatus according to claim 1, further comprising a dielectric cover layer covering the one or more radiating elements on a side of the one or more radiating elements not facing the dielectric layer, wherein the dielectric cover layer is made from food grade material.

6. The heating apparatus according to claim 1, wherein the radiating plate is structured and arranged to act as a load bearing plate capable of supporting a weight of 1 kg.

7. The heating apparatus according to claim 1, further comprising a plurality of decoupled radiating elements decoupled from each other at the microwave working frequencies, each fed by a respective feed.

8. The heating apparatus according to claim 7, wherein pairs of the plurality of decoupled radiating elements are decoupled by a respective choke.

9. The heating apparatus according to claim 1, wherein the one or more radiating elements are printed on the dielectric layer.

10. The heating apparatus as claimed in claim 1, wherein the radiating plate is disposed in a tray configuration, enabling the object to rest on top of the radiating plate when the object is disposed adjacent to the radiating plate.

11. The heating apparatus as claimed in claim 1, wherein the radiating plate is disposed so that the object disposed in the enclosure for heating rests below the radiating plate.

12. The heating apparatus as claimed in claim 10, wherein a plurality of radiating plates are mutually spaced in a vertical direction to accommodate the object between each pair of the plurality of radiating plates.

13. The heating apparatus as claimed in claim 1, the apparatus further comprising:

a controller coupled to the microwave power source and configured to control the microwave power source based on feedback received from the radiating plate.

14. The heating apparatus as claimed in claim 13, wherein the controller is configured to change one of:

frequency;

phase between a pair of feeding ports;

amplitude of one feeding port relative to another feeding port;

frequency, and phase between a pair of feeding ports;

frequency, and amplitude of one feeding port relative to another feeding port;

frequency, phase between a pair of feeding ports, and amplitude of one feeding port relative to another feeding port; and phase between a pair of feeding ports, and amplitude of one feeding port relative to another feeding port, according to which energy is supplied to increase the contact efficiency in response to the feedback.

15. The heating apparatus as claimed in claim 13, wherein the microwave power source is configured to selectively couple one or more feeds of the radiating plate to the microwave power source and the controller is configured to increase the contact efficiency, in response to the feedback.

16. The heating apparatus as claimed in claim 1, further comprising: a secondary heating arrangement, wherein a controller is arranged to cause heating of the test load using the secondary heating arrangement until the contact efficiency is estimated to have risen above a threshold value and cause heating of the test load using the radiating plate once the contact efficiency is estimated to have risen above the threshold value.

17. The heating apparatus as claimed in claim 16, wherein the secondary heating arrangement comprises a microwave heating arrangement.

18. The heating apparatus as claimed in claim 16, wherein the secondary heating arrangement comprises a convection heater for causing circulation of heated air around the object.

19. The heating apparatus as claimed in claim 16, wherein the secondary heating arrangement is a resistive or inductive heating arrangement comprising a resistive or inductive heating element.

20. The heating apparatus as claimed in claim 19, wherein the resistive or inductive heating element is embedded in the radiating plate.

21. A heating apparatus for heating an object, the apparatus comprising an enclosure for accepting the object adjacent to a radiating plate for heating and a microwave power source coupled to the radiating plate and configured to feed the radiating plate at one or more microwave frequencies, wherein:

the radiating plate is an object heating radiating plate, configured to heat the object with feed signals having a range of microwave working frequencies of between 300 MHz and 3 GHz, and the radiating plate comprises:

a ground plate; and at least one or more radiating elements spaced from the ground plate by a dielectric layer, wherein at least a size and a shape of the one or more radiating elements and at least a thickness of the dielectric layer satisfy the following conditions:

the one or more radiating elements are configured to resonate at a wavelength corresponding to a test frequency within the range of microwave working frequencies in a medium having a dielectric constant in the range of 20 to 60 and a loss tangent in the range of 0.1 to 0.5, wherein said conditions are configured to provide a first amount of energy transfer from the radiating plate to the test load with the radiating plate being in contact with the test load while providing a second amount of energy transfer, smaller than the first amount, with the radiating plate not being in contact with the test load.

22. The heating apparatus as claimed in claim 1, wherein the dielectric layer is an air layer.

23. The heating apparatus as claimed in claim 17, wherein the microwave heating arrangement comprises a microwave cavity housing the radiating plate and a separate radiating element.

24. The heating apparatus as claimed in claim 23, wherein the separate radiating element is fed by a magnetron.

25. A heating apparatus for heating an object, the apparatus comprising an enclosure for accepting the object adjacent to a radiating plate for heating and a microwave power source coupled to the radiating plate and configured to feed the radiating plate at one or more microwave frequencies, wherein:

the radiating plate is an object heating radiating plate configured to heat the object, comprising:

a conductive base plate;

a dielectric layer covering a surface of the conductive base plate;

at least one radiating element electrically isolated from the conductive base plate by the dielectric layer;

a second dielectric layer covering the at least one radiating element; and at least one port extending through the conductive base plate, through which the at least one radiating element is supplied with energy from a microwave source that is configured to supply the at least one radiating element with frequencies in a range of working frequencies of between 300 MHz and 3 GHz, wherein at least a size and a shape of the one or more radiating elements and at least a thickness of the dielectric layer satisfy the following conditions:

the at least one radiating element is configured to resonate at a wavelength corresponding to a test frequency within the range of the working frequencies in a medium having a dielectric constant in the range of 20 to 60 and a loss tangent in the range of 0.1 to 0.5, and the radiating plate has a free space efficiency of less than −6 dB, wherein said conditions are configured to provide a first amount of energy transfer from the radiating plate to the test load with the radiating plate being in contact with the test load while providing a second amount of energy transfer, smaller than the first amount, with the radiating plate not being in contact with the test load.

26. The heating apparatus according to claim 1, wherein the test load has a dielectric constant of 40.

27. The heating apparatus according to claim 1, wherein the test load has a loss tangent of 0.3.

* * * * *